US006708413B2

(12) United States Patent
Carlson et al.

(10) Patent No.: US 6,708,413 B2
(45) Date of Patent: Mar. 23, 2004

(54) SHAPE AND ENVELOPE CUTTING SYSTEM

(75) Inventors: Christopher Robert Carlson, Wausau, WI (US); William J. Schulz, Mosinee, WI (US); Jamieson A. Foght, Middleton, WI (US)

(73) Assignee: Alterra Holdings Corporation, Tigard, OR (US)

( * ) Notice: Subject to any disclaimer, the term of this patent is extended or adjusted under 35 U.S.C. 154(b) by 0 days.

(21) Appl. No.: 10/037,167

(22) Filed: Dec. 31, 2001

(65) Prior Publication Data

US 2002/0124423 A1 Sep. 12, 2002

Related U.S. Application Data

(63) Continuation-in-part of application No. 09/769,683, filed on Jan. 25, 2001.

(51) Int. Cl.[7] ..... B43L 13/20

(52) U.S. Cl. ..... 33/27.12; 33/562; 33/566; 30/293; 30/296.1

(58) Field of Search ..... 33/18.1, 27.12, 33/41.5, 528, 562, 563, 566; 408/204, 703; 30/300, 310, 315, 316, 293, 294, 296.1; 144/144.1, 372; 493/216, 223, 227

(56) References Cited

U.S. PATENT DOCUMENTS 3,156,984 A * 11/1964 Palmer ..... 33/562
3,633,286 A * 1/1972 Maurer ..... 33/563
3,753,384 A * 8/1973 Anfindsen ..... 33/18.1
3,778,905 A * 12/1973 Jebb et al. ..... 33/18.1
4,319,615 A * 3/1982 Ditmanson ..... 144/144.1
4,353,672 A * 10/1982 Smith ..... 33/562
4,382,590 A * 5/1983 Pandya et al. ..... 33/32.2
4,934,054 A * 6/1990 Morozumi ..... 33/27.12
5,156,584 A * 10/1992 Cohen et al. ..... 493/472
5,414,933 A * 5/1995 Garner ..... 30/315
5,503,203 A * 4/1996 Stornetta ..... 144/372
5,518,491 A * 5/1996 Romer et al. ..... 493/231
5,626,551 A * 5/1997 Kearns et al. ..... 493/231
5,685,816 A * 11/1997 Romer ..... 493/231
5,855,543 A * 1/1999 Carbone ..... 493/59
5,865,928 A * 2/1999 Lariviere, Jr. et al. ..... 156/256
6,036,628 A * 3/2000 Romer ..... 493/57
6,112,425 A * 9/2000 Nelson et al. ..... 33/566
6,158,133 A * 12/2000 Carlson et al. ..... 30/300

* cited by examiner

*Primary Examiner*—Diego Gutierrez
*Assistant Examiner*—Madeline Gonzalez
(74) *Attorney, Agent, or Firm*—Foley & Lardner

(57) ABSTRACT

An envelope or package cutting system for cutting a material having a surface. The envelope cutting system includes a cutting unit and at least one template having the opening that is the shape of an unfolded envelope. The cutting unit includes a frame, a blade adjustment assembly and a blade assembly which are coupled to the frame. The blade assembly is positioned at least partially within the frame such that a longitudinal axis of the blade assembly is substantially perpendicular to a lower support surface of the frame. The blade assembly includes a blade retainer and a blade connected to the retainer. A rigid collar of the retainer is configured to operatively engage at least one of a periphery and the edge of the opening of the template thereby enabling the blade to cut a shape in the cutting material which assimilates the shape of an unfolded envelope.

20 Claims, 20 Drawing Sheets

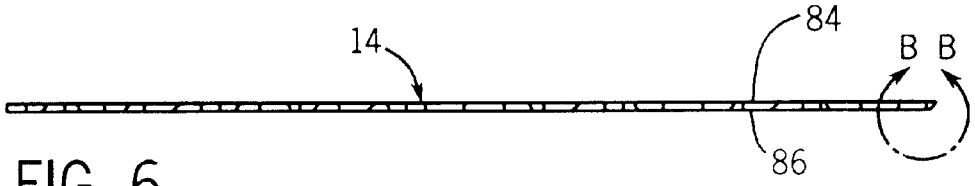
FIG. 6
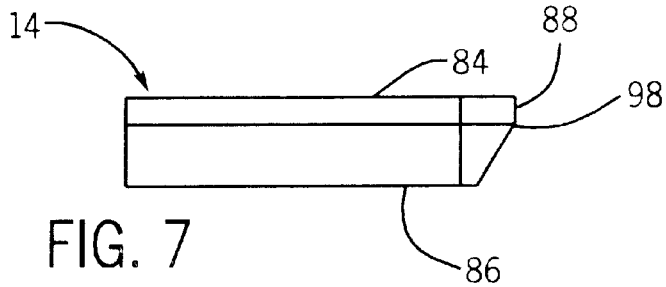
FIG. 7
FIG. 8A
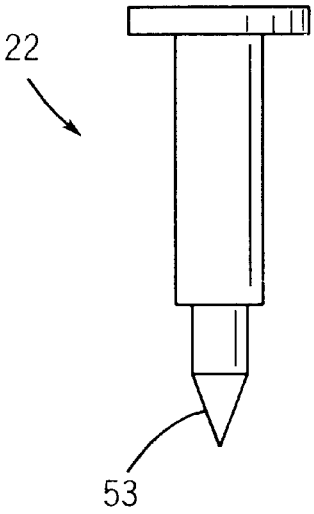
FIG. 8B
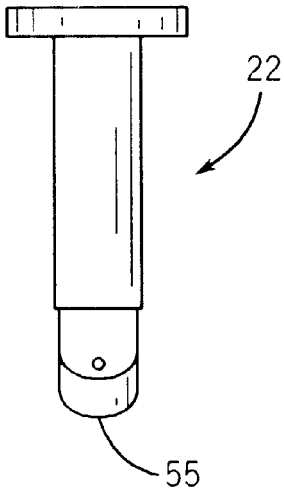

SHAPE AND ENVELOPE CUTTING SYSTEM

This is a continuation-in-part of United States Patent Application No. 09/769,683, filed Jan. 25, 2001.

FIELD OF THE INVENTION

The present invention relates generally to a shape and envelope rendering systems. More particularly, the present invention relates to the field of marking devices, including cutting devices and templates.

BACKGROUND OF THE INVENTION

Devices for rendering marks upon materials such as paper, cardstock and photographs are generally well known. Such devices, including cutting devices, are typically configured for performing free-form marking or cutting. Many marking devices are also used in conjunction with a template for marking or cutting specific or predetermined shapes from a material. Cutting devices having an adjustable blade are also known and are typically used for cutting materials of varying thicknesses. Other cutting devices can include a swiveling blade which swivel or rotate about a longitudinal axis of the cutting device. Cutting devices typically are elongate members having housings which form a handle for grasping by a user during cutting. The housing usually connects at its lower end to the blade. The angular position of the cutting blade of the cutting device with respect to the material to be cut is typically determined by the user's hand.

Templates are also well known. Templates typically are flat sheets having first and second sides, and one or more openings are formed in a variety of different shapes. The cross-sectional shape, of the periphery of the template and the edges of the template at the openings, typically defines straight-cut edges extending perpendicularly from the first side to the second side. Templates are commonly made of semi-transparent, generally flexible material. Templates used to produce geometric or other shapes of varying sizes can also be configured as nested templates. Nested templates include a series of elongate, unconnected slots which form outlines of specific shapes. When using nested templates, the user is required to cut the portions of the material to be cut which extend between the ends of the slots in order to completely outline or cut out the desired shape.

Existing devices for rendering marks and existing templates have a number of drawbacks. Existing rendering or cutting devices are typically not securely orientated in regard to angle with respect to the material. As a result, the angular orientation of the device with respect to the material to be cut (e.g., the blade of a cutting device) is often inadvertently changed causing an error in the desired marking or cutting. Existing devices which do fix the angular orientation of the cutting device with respect to the material are typically configured for free-form cutting only and do not properly function in conjunction with templates. Other devices which fix the angular orientation of the cutting device with the material to be cut are large, expensive devices which are often difficult to operate and to transport.

Further, existing cutting devices are typically formed of non-transparent material which partially obstructs the user's view of the material to be cut. Also, many cutting devices utilize a bottom-load blade connection of the blade to the housing of the device. The bottom-load connection of the blade to the housing makes the blade susceptible to becoming dislodged from the housing during operation. Existing cutting devices also typically do not include blade depth indication which increases the likelihood of blade depth mis-adjustment. Existing cutting devices also typically do not accommodate spare blades or blade assemblies. Those cutting devices, which have a rotatable or swivelable blade, are not typically configured for use with a template. When not in operation, existing cutting devices often have exposed cutting blades which are susceptible to contact by the user.

Existing templates are not configured for effective operation with cutting devices, and in particular, with cutting devices wherein the housing and the blade assembly are maintained in a generally fixed orientation with respect to the template. The periphery and the edges at the openings of existing templates often cause existing rotatable or swiveling blade assemblies to bind which can result in mis-cuts. Also, existing nested templates produce incomplete shapes and require the user to undertake a secondary cutting or marking operation, typically without the aid of the template, to complete the cutting or marking of the desired shape.

Thus, there is a need for a device for rendering marks or cuts onto a material which maintains the marking assembly in substantially constant angular orientation with respect to the material to be cut and which is configured for use in either a free-form rendering mode or a template rendering mode. There is also a continuing need for a cutting device which is configured for single-hand operation and which can be adjusted without the use of tools. What is needed is a cutting device having a blade assembly which is not susceptible to separation from the lower portion of the housing and a cutting device which indicates the depth of the cutting blade. A cutting device configured to prevent contact by a person with the blade when the device is not in use is also needed. Further, there is a continuing need for a cutting device having many of these attributes which also accommodates spare blade assemblies and which enables the replacement of blades without the use of tools. Additionally, there is a need for a template which operates effectively with a rotatable or swiveling cutting blade of a cutting device. In addition, a template is needed which enables the continuous and uninterrupted cutting of shapes of varying sizes.

SUMMARY OF THE INVENTION

The present invention provides a shape and envelope cutting system for cutting a material having a surface. The shape and cutting system includes a cutting unit and at least one template. The cutting unit includes a frame, a blade adjustment assembly coupled to the frame, and a blade assembly coupled to the frame. The frame has a lower support surface. The blade assembly is positioned at least partially within the frame such that a longitudinal axis of the blade assembly is substantially perpendicular to the lower support surface of the frame. The blade assembly includes a blade retainer and a blade connected to the retainer which has a rigid collar. The blade assembly is rotatable about the longitudinal axis. The at least one template has first and second substantially flat surfaces, a periphery and at least one edge defining at least one opening. The frame of the cutting unit has a lower surface for contacting at least one of the first surface of the template and the material to be cut. The second surface of the template is configured for placement upon the material to be cut. The rigid collar of the retainer is configured to operatively engage either the periphery of the edge of the opening of the template. The engagement of the collar to the template enables the blade to cut a shape in the cutting material which assimilates the shape of at least a portion of the at least one of the periphery and the edge.

According to a principal aspect of a preferred form of the invention, a device is provided for rendering shapes upon a material wherein the device may be used in conjunction with at least one template. The device includes a frame, a marking device adjustment assembly and a marking device assembly. The frame includes a base and a housing. The base includes a substantially flat lower surface for contacting one of the material to be cut and the template. The housing is coupled to the base and also has first and second interconnected openings. The housing is supported by the base in at least one position above the lower surface of the base. A marking device adjustment assembly is coupled to the housing at the first opening. A marking device assembly is operatively coupled to the marking device adjustment assembly. The marking device assembly is at least partially enclosed by the housing at the second opening of the housing. The second opening of the housing is sized to enable a lower portion of the marking device assembly to partially and adjustably extend through the second opening and to prevent the marking device assembly from fully extending through the second opening.

According to another aspect of the invention, a device is included for rendering shapes upon a material wherein the device may be used in conjunction with at least one template. The device includes a frame, a marking device adjustment assembly, and a marking device assembly. The frame has a substantially flat lower surface for contacting one of the material to be cut and the template. The flat lower surface is sized to support the frame in an upright position. The marking device adjustment assembly is coupled to the frame. The marking device assembly is at least partially enclosed by the frame and is operatively coupled to the marking device adjustment assembly. The frame has a storage compartment for storing at least an additional marking device assembly.

According to another aspect of the invention, a template is included for facilitating the rendering of shapes onto a material by a rendering device. The template includes a substantially flat sheet having first and second sides, a periphery and at least one opening extending from the first side to the second side. The first side of the sheet is configured for placement upon the material to be cut. The second side of the sheet is configured to contact the rendering device. The sheet is made of a semi-transparent tinted template material. The first side laterally extends at the periphery and at the one opening farther than the second side to define a chamfer at the periphery and at the one opening of the template.

According to still another aspect of the invention, an envelope cutting system having a surface comprises a cutting unit including a frame having a lower support surface, a blade adjustment assembly coupled to the frame, and a blade assembly coupled to the frame. The blade assembly is positioned at least partially within the frame such that a longitudinal axis of the blade assembly is substantially perpendicular to the lower support surface of the frame. The blade assembly includes a blade retainer and a blade connected to the retainer, the retainer having a rigid collar, and the blade assembly rotatable about the longitudinal axis. At least one template includes first and second substantially flat surfaces, a periphery and at least one edge defining at least one opening forming the shape of an unfolded envelope. The lower support surface of the frame is configured for contacting at least one of the first surface of the template and the material to be cut. The second surface of the template is configured for placement upon the material to be cut, and the rigid collar of the retainer is configured to operatively engage at least one of the periphery and the edge of the opening of the template, thereby enabling the blade to cut a shape in the cutting material which assimilates the shape of at least a portion of the at least one of the periphery and the edge.

This invention will become more fully understood from the following detailed description, taken in conjunction with the accompanying drawings described herein below, and wherein like reference numerals refer to like parts.

BRIEF DESCRIPTION OF THE DRAWINGS

FIG. 6 is a side view of the template of FIG. 5;

FIG. 7 is a detailed view of the template along the section B of the template of FIG. 6;

FIG. 8A is a side view of a blade assembly in accordance with an alternative preferred embodiment of the present invention; and FIG. 8B is a side view of a blade assembly in accordance with another alternative preferred embodiment of the present invention;

DETAILED DESCRIPTION OF THE PREFERRED EMBODIMENTS

Figure 1:
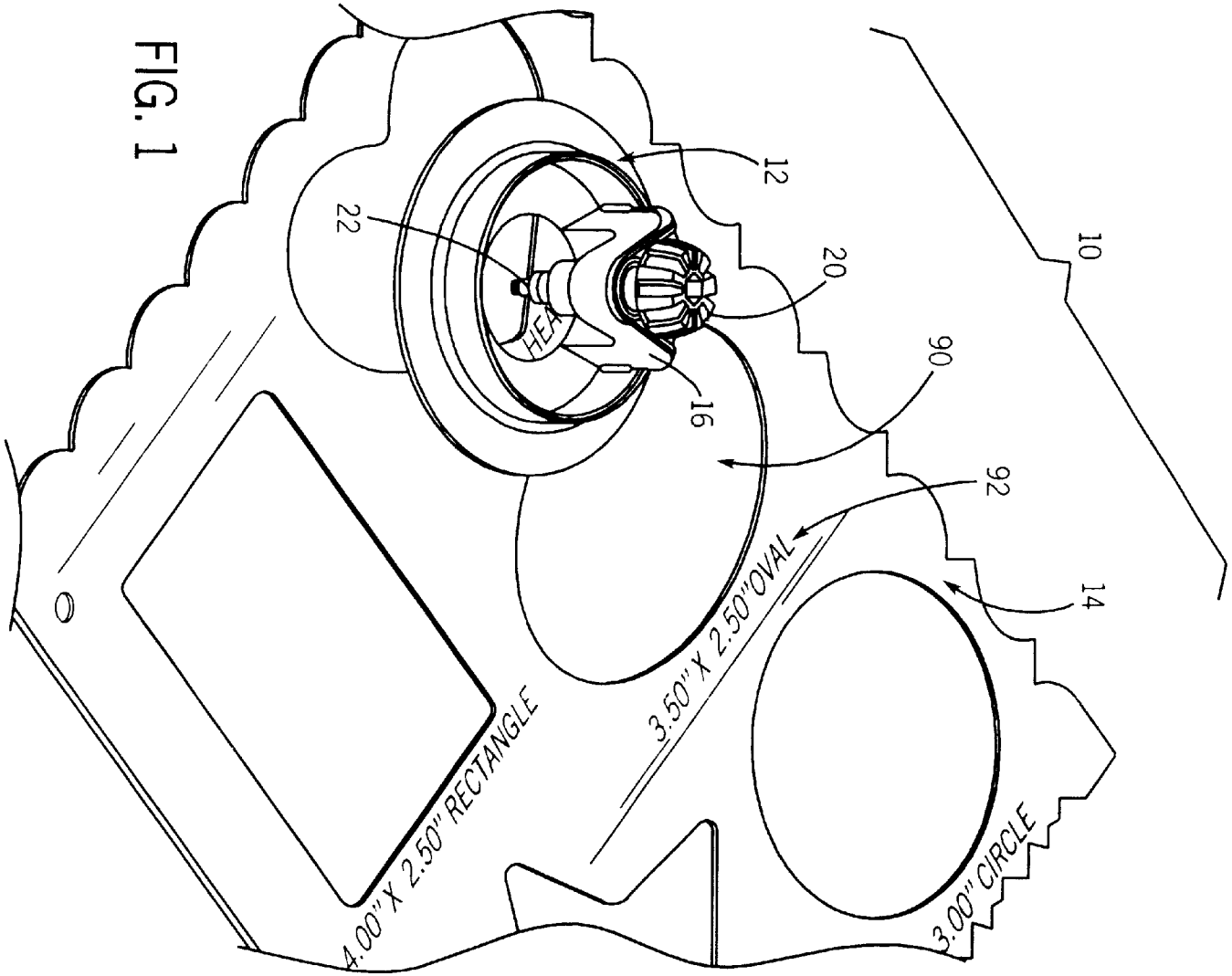
FIG. 1 is a perspective view of the cutting system, including a cutting unit and a template, in accordance with a preferred embodiment of the present invention.

Referring to FIG. 1, a shape cutting system is indicated generally at 10. The shape cutting system 10 includes a cutting unit 12, at least one template 14 and further includes a cutting mat 15 (see FIG. 5). The cutting unit 12 is a lightweight, handheld positionable assembly configured for operation with one of the templates 14 and for application directly onto a material to be cut without templates. The cutting unit 12 is also configured to cut material such as paper, card stock, photographs, and other cutable goods into desired shapes or patterns. The cutting unit 12 functions in at least two operating modes. In the first operating mode, a free-form or free-hand mode, the cutting unit 12 is placed directly upon the material to be cut and is translated preferably by a single hand of the user, in the desired direction across the material to perform free-form cutting. In the second mode of operation, the template cutting mode, the cutting unit 12 works in conjunction with at least one of the templates 14 to cut a prescribed or predetermined pattern, segment or shape, as outlined by the template 14 and as desired by the user. In an alternative preferred embodiment, the shape cutting system 10 can be used to render marks, not including cuts, onto a material as opposed to cutting the material. In such a preferred embodiment, the cutting unit 12 would be substituted with another marking device, such as a writing instrument. The cutting unit 12 is sized for ambidextrous single hand operation and to be easily transported or stored.

Figure 2:
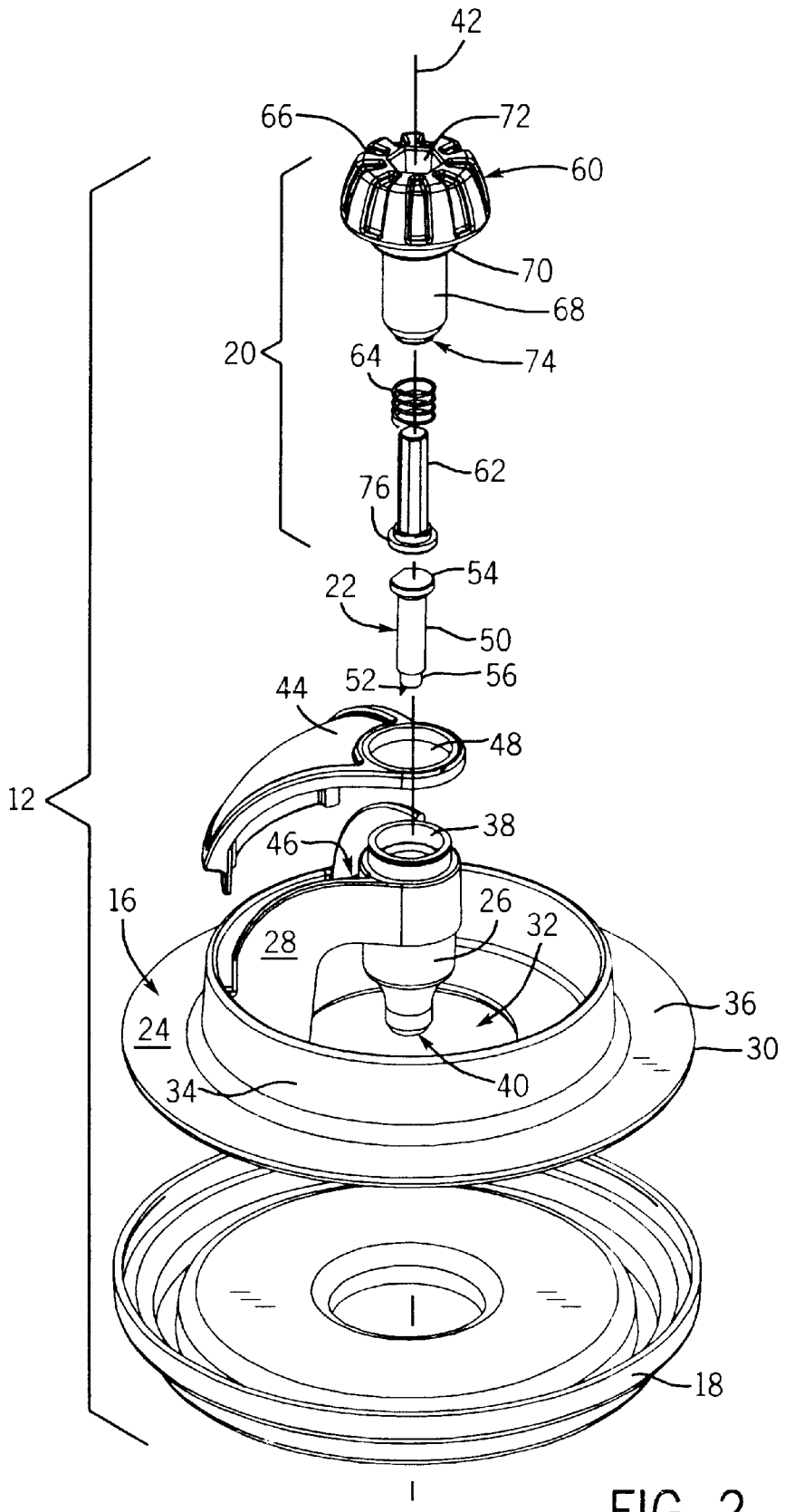
FIG. 2 is an exploded perspective view of a cutting unit of the shape cutting system of FIG. 1.

FIG. 2 illustrates the cutting unit 12 in greater detail. The cutting unit 12 includes a frame 16, a protective cover 18, a blade adjustment assembly 20 and a swivel blade assembly 22. The frame 16 is preferably a handheld, one-piece support structure. The frame 16 is preferably configured for supporting and partially enclosing the blade adjustment assembly 20 and the swivel blade assembly 22. The frame 16 is also configured for removable contact with the template 14 or the material to be cut. The frame 16 is made of a durable, lightweight material, preferably, a clear, semi-transparent polycarbonate material. Alternatively, the frame 16 can be made of different materials such as, for example, other thermoplastic materials, metal, wood or glass.

The frame 16 includes a base 24, a housing 26 and an arm 28. The base 24 is a support structure having a substantially flat lower surface 30 and an aperture 32 defined within its center. The base 24 is coupled to the housing 26 by the arm 28. The base 24 is configured to be easily translated over a surface of the material to be cut or an outer surface of one of the templates 14. The base 24 is also configured to securely support the housing 26 in a fixed position. In a preferred embodiment, the base 24 securely and integrally supports the housing 26 in a position substantially perpendicular to the lower surface 30 of the base 24. The aperture 32 is configured to enable the blade assembly 22 to partially extend therethrough during operation. The base 24 further includes a wall 34 upwardly extending from an upper surface 36 of the base 24. The wall 34 and the upper surface 36 of the base 24 combine to provide an annular handle which is configured to be easily grasped by the user enabling the user to easily move the cutting unit 12 in any direction across a surface of the material to be cut or the template 14. The base 24 is preferably an annular member. Alternatively, the base 24 can be formed in other shapes such as, for example, a rectangular shape, an oval shape, a U-shape, or other conventional shapes.

The housing 26 is a generally cylindrical body having first and second openings 38 and 40. The housing 26 is preferably integrally connected to the arm 28 and coupled to the base 24. The first and second openings 38 and 40 of the housing 26 are defined to interconnect and axially extend through the housing 26 along a longitudinal axis 42. The housing 26 is removably connected to, and partially encloses, the blade assembly 22 at the second opening 40 and the blade adjustment assembly 20 at the first opening 38. The housing 26 is configured to retain at least a portion of the blade assembly 22 and a portion of the blade adjusting assembly 20. The housing 26 also allows top-loading of the blade assembly 22 into the housing 26 through the first opening 38. The housing 26 is also configured to prevent the blade assembly 22 from fully extending through the second opening 40 of the housing 26. This feature prevents the inadvertent separation or dislocation of the blade assembly 22 from the lower end of the housing 26 during operation. The housing 26 is also configured to enable the blade assembly 22 to move axially in a plurality of different positions based upon the adjustment of the blade adjustment assembly 20, and to enable the blade assembly 22 to rotate, pivot and swivel about the axis 42 during operation.

The arm 28 is a curved support structure. The arm 28 is also preferably integrally connected to the base 24 and to the housing 26 for supporting the housing 26 above the aperture 32 of the base 24. The arm 28 is configured to fixedly secure the housing 26 along the axis 42 in a position substantially vertical to the lower surface 30 of the base 24. This configuration ensures that the blade assembly 22 is continuously maintained by the housing 26, and the frame 16 is maintained in position in a substantially vertical position with respect to the base 24 when the base 24 is placed on a substantially horizontal surface. When in use, the arm 28 fixedly secures the angular orientation of the housing 26 with respect to the material to be cut. The configuration of the frame 16 eliminates the need for the user of the cutting unit 12 to adjust the angular orientation of the housing 26 and the swivel blade assembly 22 during operation. In alternative embodiments, the arm 28 can be configured to support the housing 26 and the blade assembly 22 in a plurality of different angular orientations with respect to the base 24.

In a preferred embodiment, the arm 28 is a generally hollow structure and further includes an arm cover 44. The arm 28, including the arm cover 44, forms a spare blade assembly storage compartment 46 for receiving at least one spare blade assembly. The arm cover 44 is a curved, and partially generally spherical, member having an opening 48 at its upper end. The arm cover 44 is pivotally connected to the upper end of the housing 26 at the opening 48. The opening 48 is configured to receive the upper end of the housing 26 and is coaxially aligned with the first opening 38 of the housing 26. The cover 44 is configured to pivot about the axis 42 to enable a user to releasably access the storage compartment 46. The arm cover 44 is made of a lightweight durable substantially transparent material, preferably, a clear polycarbonate material. Alternatively, the arm cover 44 can be made of other materials such as, for example, other thermoplastic materials or glass.

The storage compartment 46 of the arm 28 is sized to hold at least one spare blade assembly. The semi-transparent material of the arm 28 readily enables the user to visually ascertain whether a replacement blade assembly is stored within the storage compartment 46 without having to reposition the arm cover 44 from the arm 28 or disassemble the cutting unit. Alternatively, the arm 28 can be formed in other shapes or configurations, and it can be formed out of two or more members extending from the base 24. Additionally, the storage compartment can be located at other locations on the frame 16, such as, for example, formed as part of the base 24.

The protective cover 18 is a generally circular disk shape. The cover 18 is removably connected to the base 24 and covers the lower surface 30 of the base 24 including the aperture 32. The cover 18 prevents a user from inadvertently contacting the blade assembly 22 when the cutting unit 12 is not in use or when the cutting unit 12 is removed from contact with the cutting material. The cap 18 is preferably made of a lightweight, flexible and durable material. Preferably, the cap 18 is made of a plastic, but alternatively, other conventional materials can also be used. The cover 18 provides a secure, lightweight, reusable and inexpensive means for safely protecting the user from contact with the blade assembly 22 when the cutting unit 12 is not in use. Alternatively, the cover 18 can be formed in other configurations which prevent contact with the blade assembly 22 installed in the frame 16, such as a cap for the lower end of the housing 26 and the blade assembly 22. In another alternative embodiment, the blade assembly 22 can be configured to be completely retractable within the housing 26.

The blade assembly 22 is removably inserted and substantially enclosed by the housing 26. The blade assembly 22 is inserted through the first opening 38 of the housing 26 and extends along the axis 42 within the housing 26 such that the lower portion of the blade assembly 22 outwardly extends from the second opening 40 of the housing 26.

The blade assembly 22 includes a blade retainer 50 and a cutting blade 52. The blade retainer 50 is preferably a cylindrical body having an enlarged upper end 54 and a lower end formed having a diameter which is smaller than the diameter of the main portion of the retainer 50. The lower end of the retainer 50 forms a collar 56. The retainer 50 is sized to fit within the first opening 38 of the housing 26, to extend through the interior of the housing 26, and to partially and adjustably extend through the second hole 40 of the housing 26. The retainer 50 is also sized to angularly rotate or swivel about the axis 42 during operation in either a clockwise or counter-clockwise direction. The swiveling or rotating feature of the blade assembly 22 with respect to the frame 16 enables the blade 52 to follow a profile or shape defined in one of the templates 14. The swiveling blade 52 can follow the free-form movement of the user's hand across a surface without requiring the separate adjustment of the blade 52 by the user during operation. The retainer 90 is configured to adjustably and axially extend within the housing 26 in response to the adjustment of the blade adjustment assembly 20. The retainer 50 is made of a lightweight durable inexpensive material, preferably a plastic. Alternatively, other materials can also be used such as, for example, wood or metal. In an alternative embodiment, the retainer 50 can be configured to retain more than one of the blades 52 or blades of varying sizes.

The upper end 54 of the retainer 50 is sized so as to prevent the retainer 50 from fully extending in an axial manner through the second opening 40 of the housing 26. The upper end 54 also includes an upper bearing surface which is configured to removably and operatively contact the blade adjusting assembly 22. This enables the retainer 50 to rotate or swivel with respect to the axis 42 and with respect to the blade adjustment assembly 20, or to move axially along the axis 42.

The collar 56 is configured to removably contact an edge of one of the templates 14 and is configured to facilitate the operation of the blade assembly 22 in conjunction with one of the templates 14. Specifically, the collar 56 is configured to slide along and rotate as necessary with respect to an edge or the periphery of the template 14, thereby enabling the blade 52 to conform to the shape defined in the template 14.

The blade 52 is preferably a conventional single-edged blade which is also preferably press-fit to the lower end of the retainer 50. The blade 52 downwardly extends from the lower end of the retainer 50 and includes a cutting edge. The cutting blade 52 is most preferably made of a metallic material. In an alternative embodiment, the blade 52 can be a double edged blade 53 (see FIG. 8A), a rotary blade 55 (see FIG. 8B) or comprise multiple blades for cutting materials such as, for example, paper, cardboard and cloth. In another alternative embodiment, the blade 52 can be replaced with a writing or marking implement or a tool, such as a drill bit.

Referring to FIG. 2, the blade adjustment assembly 20 is an adjustable device removably connected to the base 24 at the first opening 38 of the housing 26. The blade adjustment assembly 20 is operatively coupled to the blade assembly 22. The blade adjustment assembly 20 is configured for the application of varying amounts of downward pressure to the blade assembly 22, which results in a corresponding variation in the amount of downward pressure applied to the blade assembly 22 for the cutting of material.

The blade adjustment assembly 20 includes a knob 60, a plunger 62 and a biasing device 64. The knob 60 is a generally cylindrical member having an operating mode indicating portion 70 formed between an enlarged upper end 66 and a smaller lower end 68. The lower end 68 of the knob 60 is removably connected to the housing 26 at the first opening 38. The lower end of the knob 60 is also operatively coupled to the plunger 62 and the biasing device 64. In a preferred embodiment, the lower end 68 of the knob 60 includes external threads which engage internal threads formed in the housing 26 at the first opening 38. The knob 60 is configured to enable a user to grasp and rotate the upper end 66 of the knob 60 in order to adjust the spring tension applied to the blade assembly 22, or to remove the knob 60 from the housing 26. The knob 60 is also configured to retain the plunger 62 and the biasing device 64 such that the blade adjustment device 20 maintains an adjustable downward force upon the blade assembly 22. The knob 60 is made of a lightweight durable material, preferably a plastic. Alternatively, the knob 60 can be made of other materials such as wood, metal or glass. The upper end 66 of the knob 60 preferably includes a plurality of outwardly extending projections to facilitate grasping and rotation of the knob 60. The upper end 66 also preferably further includes an opening 72 for receiving a tool, such as an "Allen" key. The lower end 68 of the knob 60 includes a plunger receiving hole 74 for receiving a portion of the plunger 62. The lower end 68 of the knob 60 is also configured to attach or connect to one end of the biasing device 64.

The plunger 62 is a cylindrical body having an upper portion and an enlarged lower contact region 76. The plunger 62 is coupled to the knob 60 via the hole 74 and is operatively connected to the blade assembly 22 at the retainer 50. The plunger 62 also is connected to and preferably partially surrounded by the biasing member 64. The plunger 62 contacts the retainer 50 of the blade assembly 22 to transmit the downward force caused by the adjustment of the knob 60 by the user for adjusting the axial position of the blade assembly 22 with respect to the housing 26. The plunger 62 is made a durable lightweight material, preferably, a plastic. Alternatively, the plunger 62 can be made out of other materials, such as, for example, wood or metal.

The biasing device 64 is connected at one end to the knob 60 and at a second end to the plunger 62. The biasing device 64 is preferably a helical spring. The biasing device 64 provides the adjustable downward force upon the lower end of the plunger 62 to continuously urge the blade assembly 22 downward and to resist upward movement of the blade assembly 22 during operation. The configuration of the cutting unit 12 advantageously eliminates the need for a user to axially orientate the cutting unit during operation.

Figure 3:
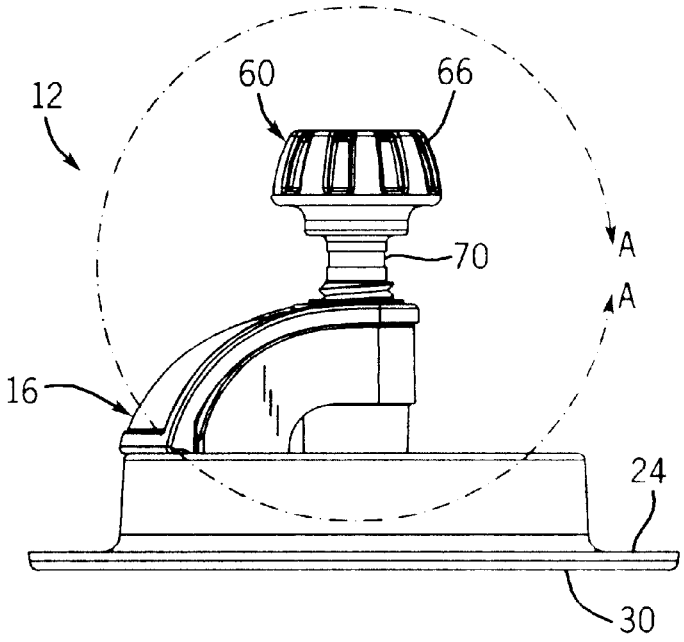
FIG. 3 is a side view of the cutting unit of FIG. 1.

FIG. 3 illustrates the cutting unit 12 in greater detail in a side view. Specifically, the substantially flat lower surface 30 of the base 24 and the operating mode indicating portion 70 of the knob 60 are illustrated. The lower surface 30 of the base 24 is also configured to place in tension the material to be cut in order to smooth out the material for efficient cutting. The operating mode indicating portion 70 is configured to reflect the operating mode of the blade assembly 22 (see FIG. 2).

Figure 4:
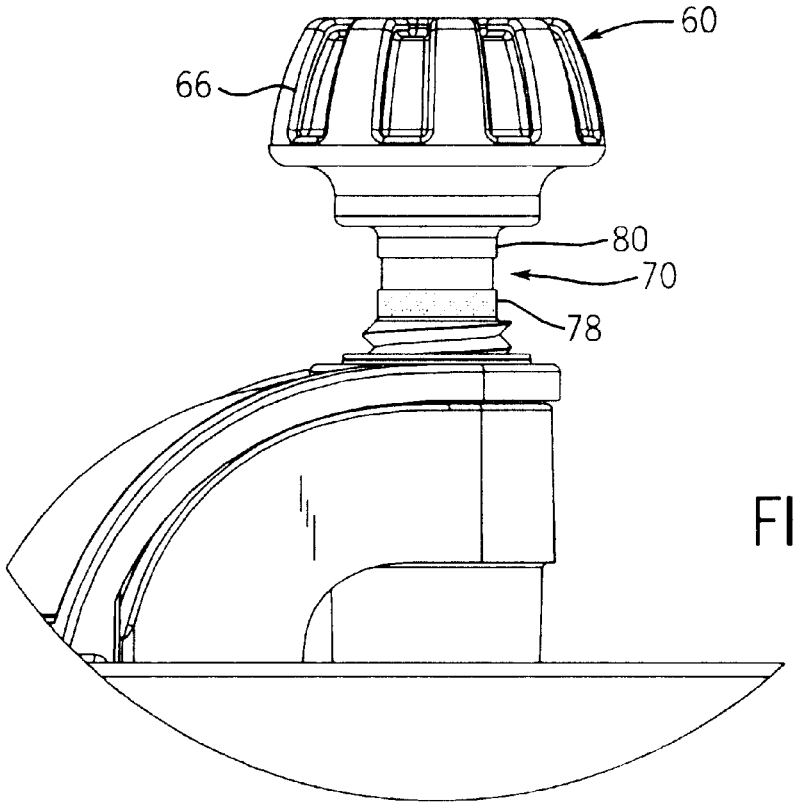
FIG. 4 is a detailed view of section A of FIG. 3.

FIG. 4 illustrates the operating mode indicating portion 70 of the knob 60 in even greater detail. The operating mode indicating portion 70 includes a free-form operating range segment 78 and a template cutting operating range segment 80. When the cutting unit 12 is operating in the free-form range, the upper end 66 of the knob 60 is positioned further away from the housing 26, thereby exposing the free-form portion 78 of the operating mode indicating portion 70 of the knob 60 above the first opening 38 of the housing 26. This indicates to the user that the cutting unit 12 is in a free-form operating mode. When in the free-form mode of operation, the upward extension of the knob 60 reduces the pressure applied from the knob 60 to the biasing device 64 by enabling the biasing device 64 to upwardly extend (see FIG. 2). The decreased pressure on the biasing device 64 results in a corresponding decrease in the pressure applied from the biasing device 64 to the plunger 62 and to the blade assembly 22. The reduced pressure exerted onto the blade assembly 22 correspondingly results in less pressure or force exerted by the blade 52 onto the material to be cut. The free-form operating range enables the blade 52 to more easily upwardly and axially deflect during operation. The reduced pressure exerted onto the blade assembly 22 results in more efficient and effective free-form movement and cutting of the blade assembly 22 during free-form operation.

When the user desires to operate the cutting unit 12 in the template cutting mode of operation, the user simply re-positions the upper end 66 of the knob 60 closer to the housing 26, until the free-form operating range segment is disposed within the housing 26 and the template cutting operating range segment 80 is visible above the first opening 38 of the housing 26. This repositioning of the upper end 66 increases the downward pressure exerted on the biasing device 64 which correspondingly results in an increase in the pressure exerted by the biasing device 64 onto the blade assembly 22. The increased pressure exerted onto the blade assembly 22 results in an increase in the pressure or force of the blade 52 against the material to be cut. When operating in the template cutting mode of operation, the blade assembly 22 deflects upward 14 less easily than when in the free-form operating mode. The increased downward pressure applied to the blade assembly 22 during the template cutting mode of operation enables the collar 54 of the blade assembly 22 to effectively contact and operate with the edges of a template while maintaining an effective cutting force on the material to be cut. The blade assembly 22 retains the ability to swivel during operation in either the free-form or the template cutting operating modes. The pressure with which the blade 52 presses against the material to be cut is determined by the position of the upper end 66 of the knob 60 with respect to the housing 26. Rotating or screwing the knob 60 down, gradually increases the pressure on the blade 52 and subsequently allows a thicker medium to be cut.

Figure 5:
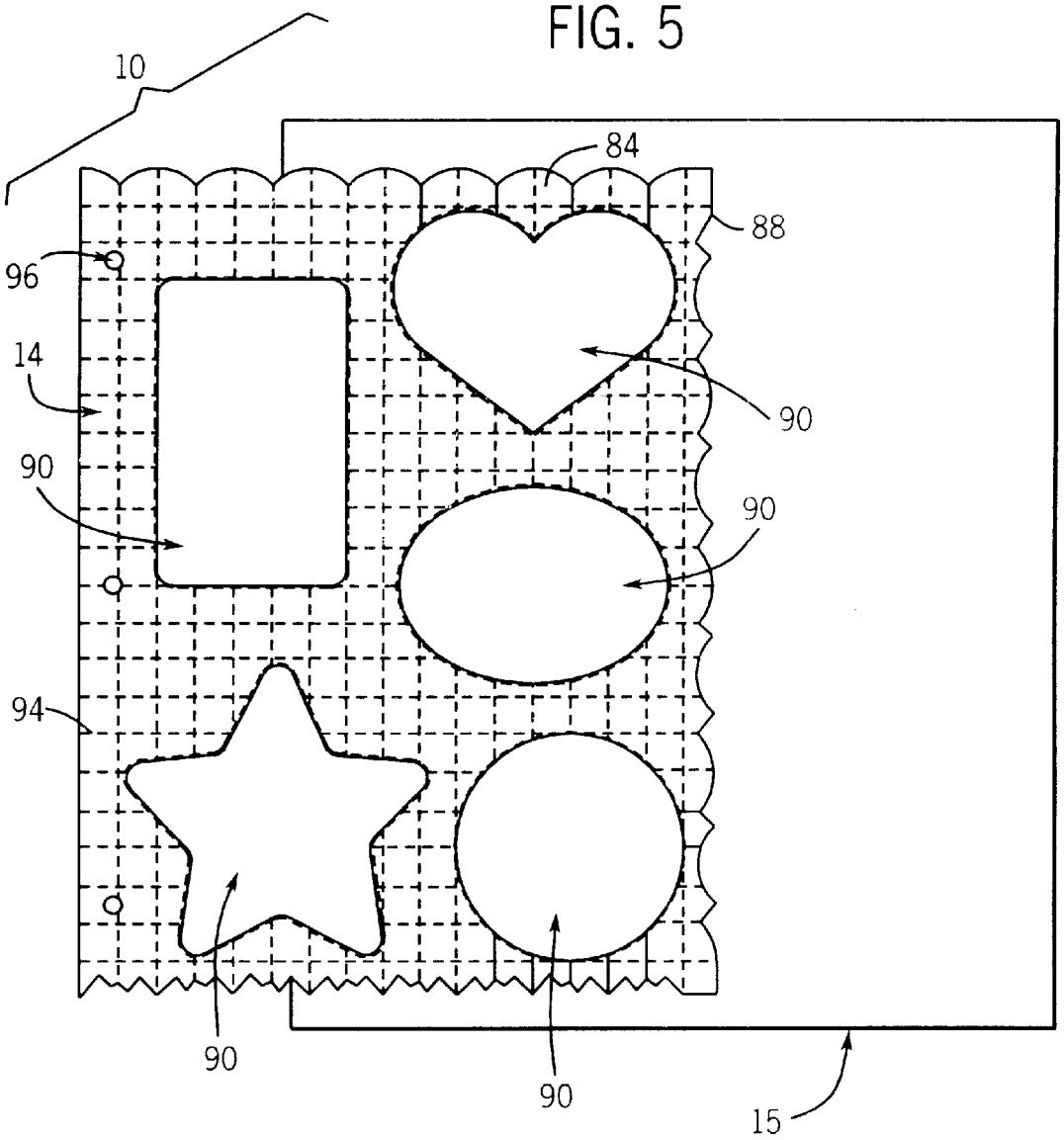
FIG. 5 is a top perspective view of a template and a mat of the shape cutting system of FIG. 1.

Referring to FIG. 5, the template 14 and the cutting mat 15 are illustrated in greater detail. The template 14 is a substantially flat sheet having first and second sides 84 and 86 (see FIGS. 5 and 6), a periphery 88 and at least one opening 90 extending from the first side 84 to the second side 86. The second side 86 of the template 14 is configured for placement upon the material to be cut. The first side 84 of the template 14 is configured to contact the cutting unit 12. The template 14 is also configured to facilitate the cutting of shapes or the rendering of marks upon a material. The template 14 is made of a lightweight and durable material. Preferably, the template 14 is made of a flexible and semi-transparent tinted material. In a particularly preferred embodiment, the template 14 is made of a thermoplastic material including an edge glow substance. The edge glow substance disposal of the semi-transparent material of the template 14 is configured to redirect light passing through the template 14 to the periphery, or to the edge of the at least one opening, of the template 14. The edge glow substance is a colorant, such as the colorant supplied by Clariant International, Ltd. The edge glow substance disposed within the material of the template 14 provides the periphery 88 and the edge of the openings 90 within the template 14 with a glowing appearance. The glowing appearance of the template 14 facilitates the placement of the cutting unit 12 onto the template 14, enhances the user's ability to view the overall template positioning, and provides the template 14 with an aesthetically appealing appearance.

The edges of the periphery 88 of the template 14 can be formed into a variety of different shapes such as illustrated in FIG. 5. The openings 90 each describe a complete shape, thereby eliminating the need for secondary cutting or operation. The openings 90 can also be formed in a variety of different shapes or families of shapes such as, for example, hearts, stars, geometric shapes and alphanumeric shapes. In a preferred embodiment, as shown in FIG. 1, the template 14 can include alphanumeric indicia 92 positioned at each opening 90 indicating of the size and/or the shape of each opening 90. For example, the indicia 92 could include "3.50"×2.50" OVAL" or 3.0" HEART". Alternatively, the indicia could be a numerical value next to an opening indicating the size of the opening 90.

Referring again to FIG. 5, the template 14 further includes gridlines 94 formed into the first surface of the template 14. The gridlines 94 facilitate the alignment of the template 14 onto the material to be cut. The template 14 can also include binder ring openings 96 for receiving a ring of a binder (not shown). Alternatively, the openings 96 can be used in conjunction with a clamping system or for template orientation.

The mat 15 is a sheet configured for placement underneath the material to be cut. The mat is configured to support the material to be cut without impeding the operation of the cutting device and to protect the surface upon which the mat 15 and the material to be cut rests. In a preferred embodiment, the mat 15 is made of a material having short or tight nap. The mat 15 is preferably made of a firm, flexible and inexpensive materials, and preferably the mat 15 is made of a thermoplastic material.

Referring to FIGS. 6 and 7, the template 14 is illustrated in further detail. The template 14 is preferably formed with a chamfer 98 at the periphery 88 and at the edges of the openings 90 within the template 14. The chamfer 98 is defined within the template 14 such that the first surface 84, which contacts the cutting unit 12, laterally and outwardly extends to a greater extent than the second surface which contacts the material to be cut. The chamfer 98 facilitates the operation of the template 14 with the cutting unit 12 by enabling the collar 56 of the blade assembly 22 to operatively engage the edge or periphery of the template 14 during operation. The chamfer 98 reduces the surface area in contact with the collar 56 of the blade assembly 22 of the cutting unit 12, thereby reducing the susceptibility of the blade assembly 22 (see FIG. 2) to bind during operation. The chamfer 98 also enables the user to more easily reposition or move the cutting unit 12, along the edge of one of the openings 90 (see FIG. 5) or the periphery 88 of the template 14, thereby facilitating the rendering or cutting of shapes onto the material to be cut. The chamfer 98 shown in FIG. 7 thus further prevents the blade 52 of the blade assembly 22 from contacting an edge, or the chamfer 98 of, the template 14 during use, thereby preserving the integrity of the edge, or the chamfer 98 of the template 14.

Additionally, referring to FIG. 5, the corners of the template 14 are configured to enable the cutting unit 12 to continuously and efficiently travel around one or more of the corners during cutting operation. This feature greatly reduces the amount of alignment required by the user when attempting to create a corner having an edge substantially similar to the template periphery 88.

Figure 9:
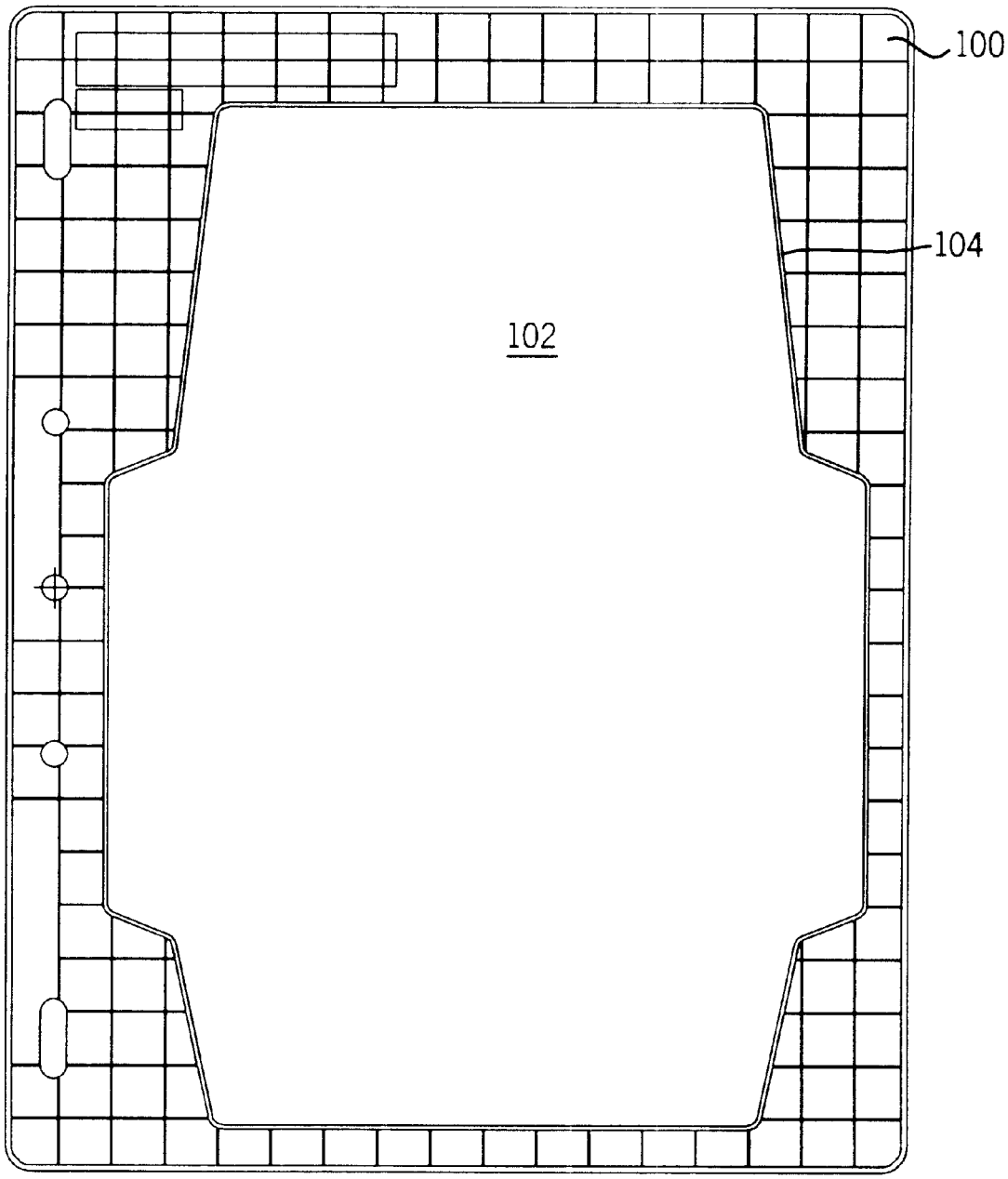
FIG. 9 is a top view of a template for cutting the shape of an envelope according to one embodiment of the present invention.

The system described herein can also be used for cutting and forming a variety of types of envelopes and/or packages of various shapes and sizes. FIG. 9 shows an example of an envelope template 100 with an opening 102 formed therein. The opening 102 corresponds to the shape of an envelope, shown as a shape or opening 99 in FIG. 10, before it is folded into a position such that it is capable of receiving materials. As in FIG. 9, the cutting unit 12 cuts the material along an edge 104 of the template 100 to form the unfolded envelope shape.

Figure 10:
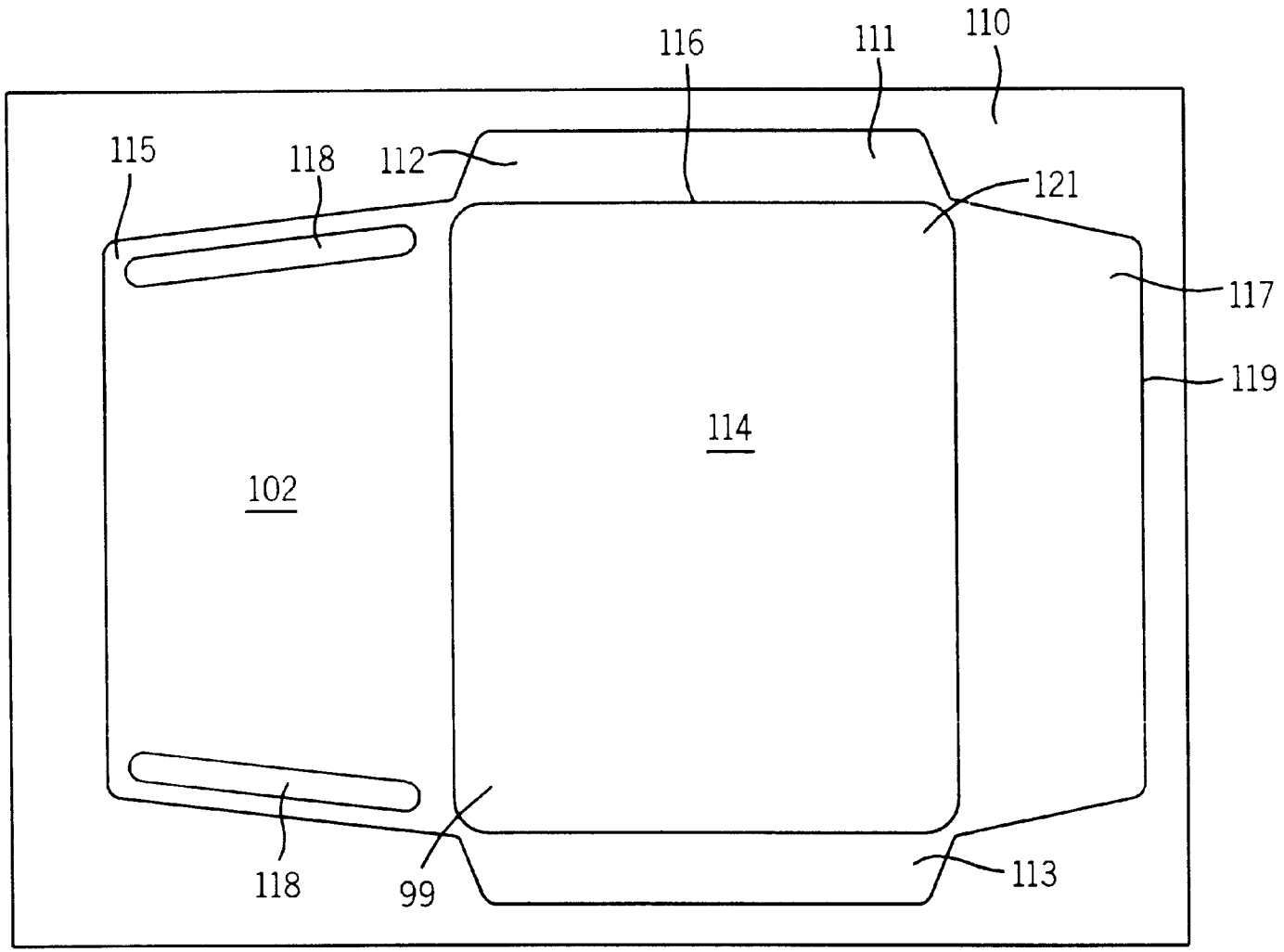
FIG. 10 is a top view of scoring plate for scoring the fold lines of the envelope defined by the template of FIG. 9.

As shown in FIG. 10, a scoring plate 110 is used to make scores or impressions on the unfolded envelope 99 once it has been cut by the cutting unit 12. In the embodiment shown in FIG. 10, the scoring plate 110 includes an opening 114 with an outer edge 116 which defines the area to be scored when the user desires to create fold lines in the unfolded envelope 99. The user presses firmly using a stylist or other hardened tool against the outer edge 116 while the unfolded envelope 99 is aligned with the outer envelope edge 119 on the scoring plate 110. The scoring plate 110 also includes a plurality of bonding slots 118. The bonding slots 118 comprise additional openings through which the user may place glue or another adhesive directly onto the unfolded envelope 99 which is placed below the scoring plate 110.

After the adhesive has been placed in the bonding slots 118, the envelope 99 is fully assembled as follows: a first side panel 111 and a second side panel 113 of the envelope 99 are folded inwardly such that they are substantially in contact with a center portion 121. The user then folds the lower panel 115 such that the adhesive that has been placed on the lower panel 115 comes into direct contact with the first and second side panels 111 and 113. The adhesive then bonds to the first and second side panels 111 or 113, forming a pocket in which the material may be placed. The upper panel 117 may then be folded atop the lower panel 115.

Figure 13:
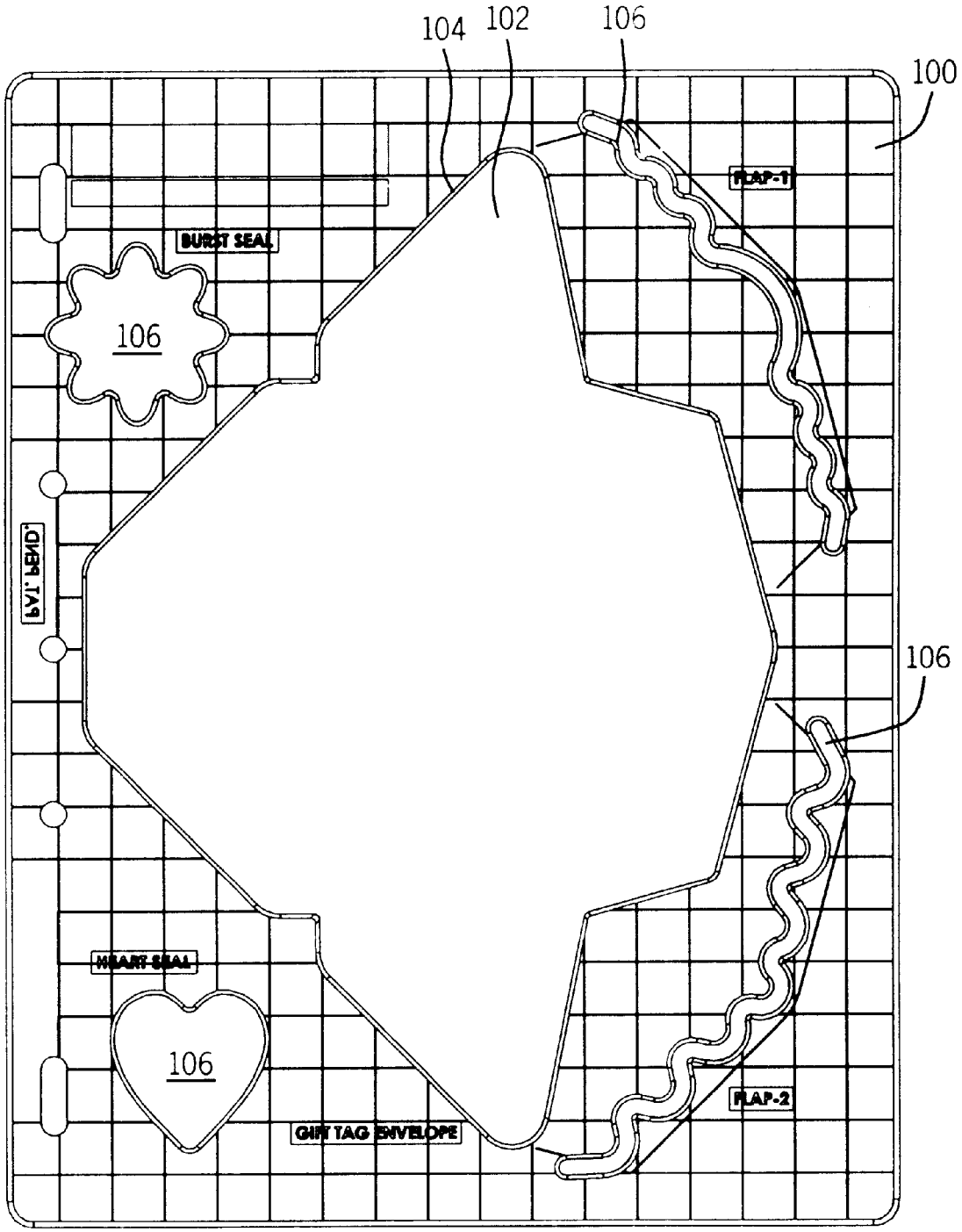
FIG. 13 is a top view of a template for cutting the shape of an envelope according to yet another embodiment of the present invention.
Figure 14:
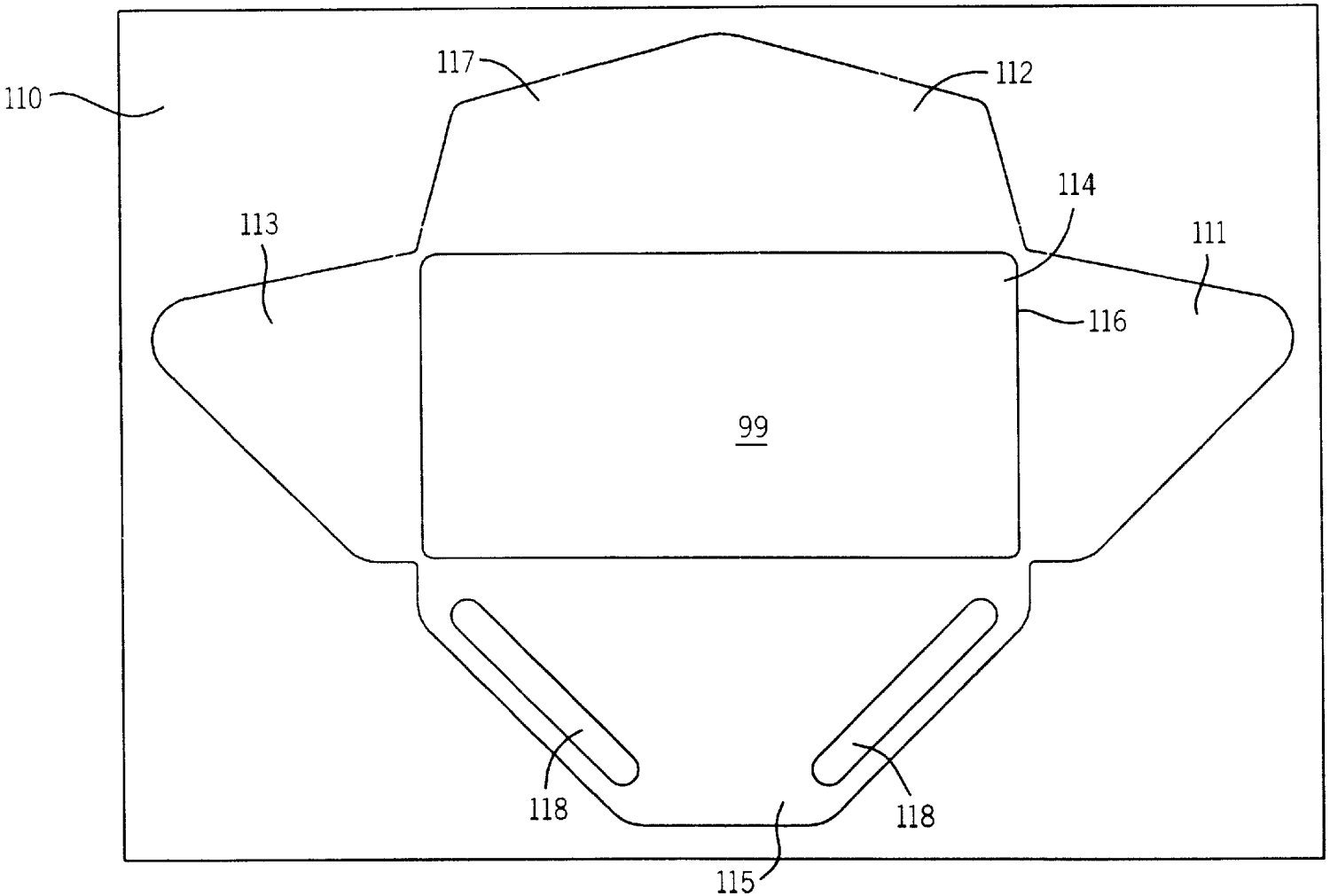
FIG. 14 is a top view of scoring plate for scoring the fold lines of the envelope defined by the template of FIG. 14.

A similar template 100 and scoring plate 110 may be used to make an envelope 99 having different shaped panels, as shown in FIGS. 13 and 14.

Figure 11:
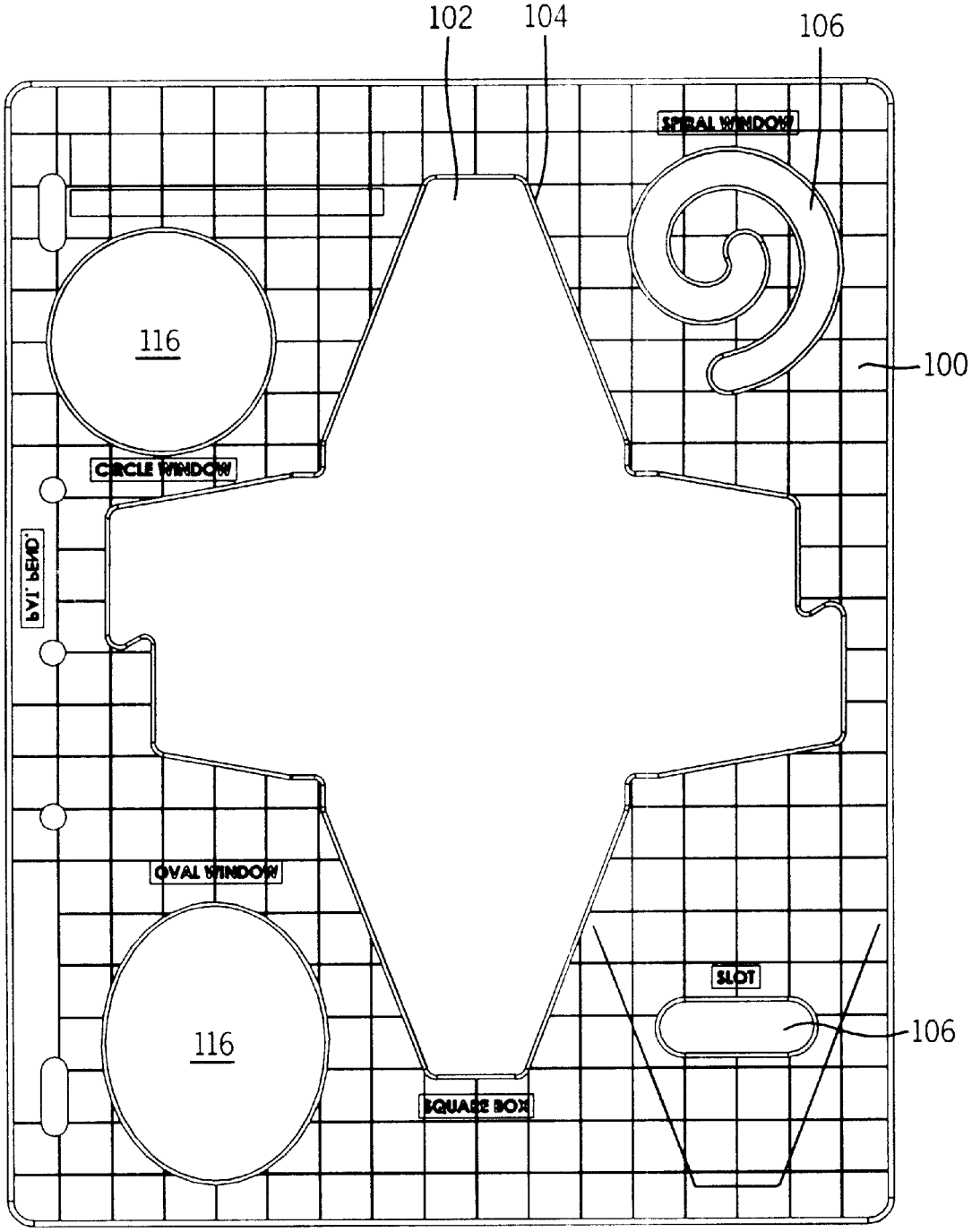
FIG. 11 is a top view of a template for cutting the shape of an envelope according to an alternate embodiment of the present invention.
Figure 12:
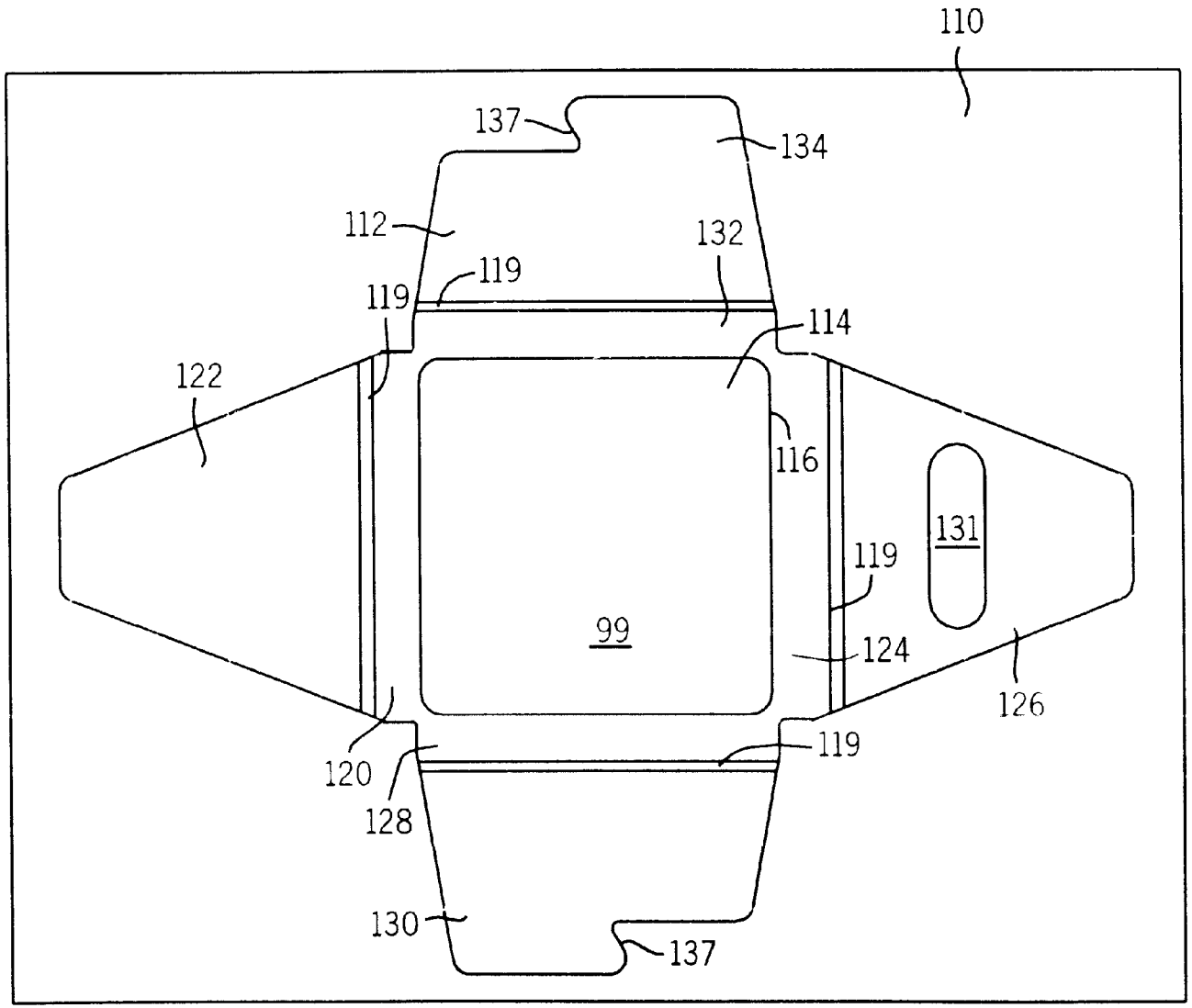
FIG. 12 is a top view of scoring plate for scoring the fold lines of the envelope defined by the template of FIG. 11.

As shown in FIGS. 11 and 12, it is also possible to form another form of envelope 99 resulting in an increased thickness such that thicker materials may be placed inside the envelope 99 once fully formed. As shown in FIG. 12, the scoring plate 110 includes additional fold lines 119 which are to be scored by a user. These additional fold lines 119 result in intermediate panels 120, 124, 128 and 132, adding additional thickness to the resulting envelope 99. In this particular embodiment of the invention, no bonding material is applied to the envelope 99. Instead, a joining slot 131 is cut into a lower panel 126. In this embodiment of the invention, the assembly of the envelope 99 is as follows. The first and second side panels 130 and 134 are joined to each other via hooks 137 formed in each of the panels 130 and 134. The lower panel 126 is then folded, and the upper panel 122 is folded such that it passes into the adjoining slot 131 on the lower panel 126.

As shown in FIGS. 11 and 13, it is also possible to include a variety of other shapes 106 into the individual template 100. These additional shapes 106 can be used either inside the envelope 99 as embossments or used to cut different edges into the unfolded envelope 99.

Figure 15:
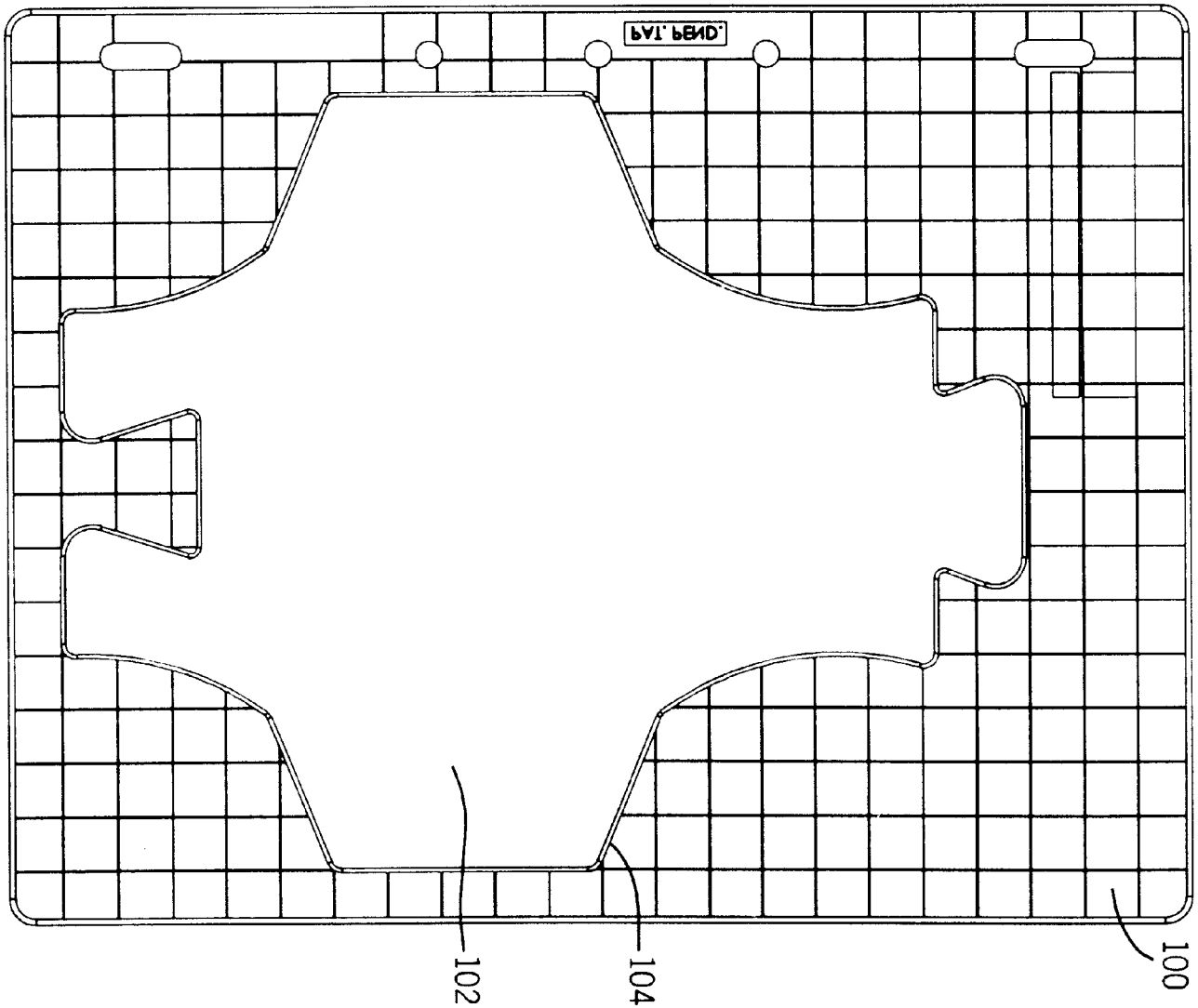
FIG. 15 is a top view of a template for cutting the shape of an envelope according to still another embodiment of the present invention.
Figure 16:
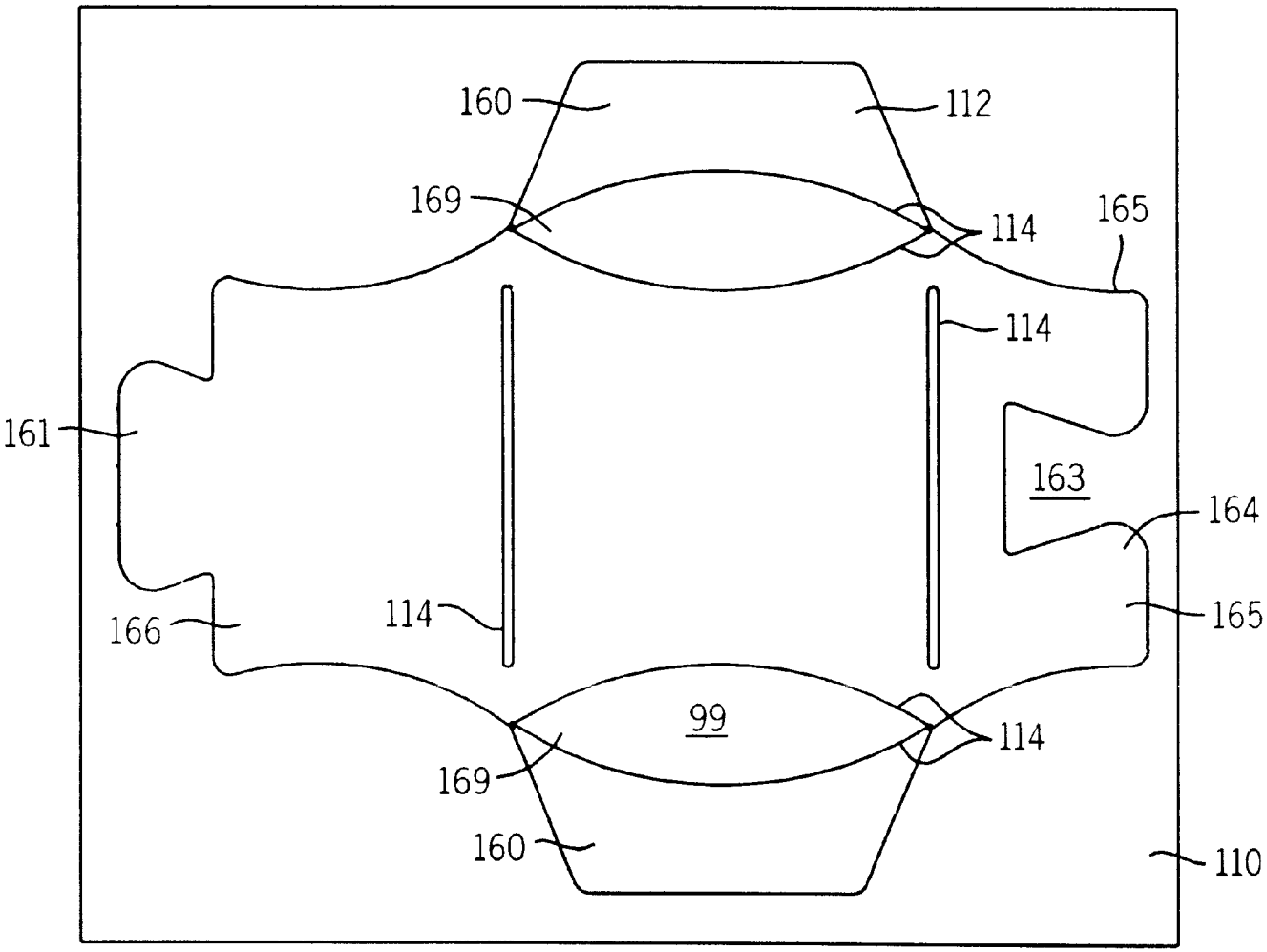
FIG. 16 is a top view of scoring plate for scoring the fold lines of the envelope defined by the template of FIG. 15.

FIGS. 15 and 16 show yet another embodiment of the invention in which additional intermediate regions 169 are formed adjacent the first and second side panels 162 and 166. After the first and second side panels 162 and 166 are folded, the lower panel 164 is folded, followed by the upper panel 166. A tab 161 formed within the upper panel 166 is then fed between a pair of tabs 165 forming the lower panel, securing the envelope 99.

Figure 17:
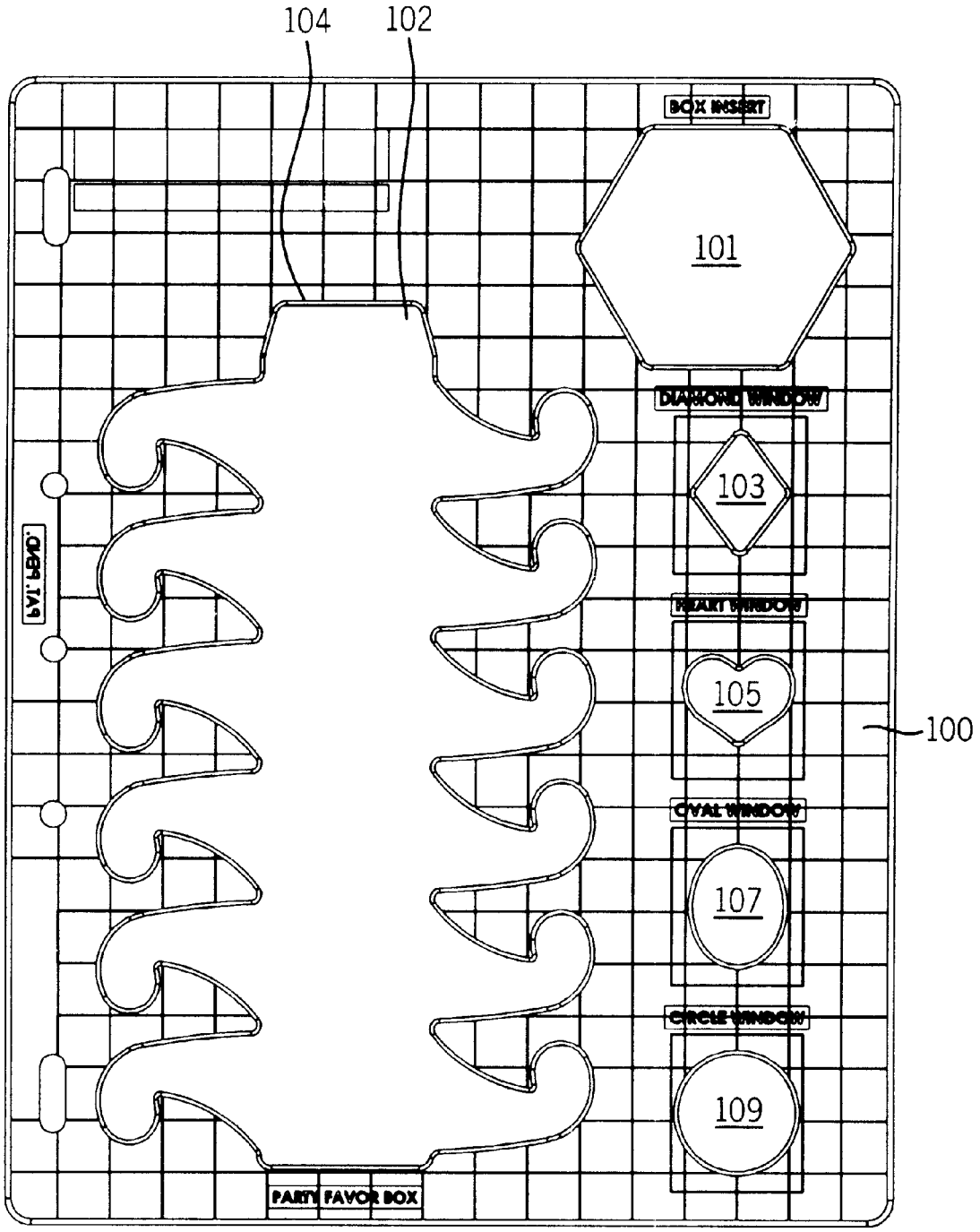
FIG. 17 is a top view of a template for cutting the shape of a box according to one embodiment of the present invention.
Figure 18A:
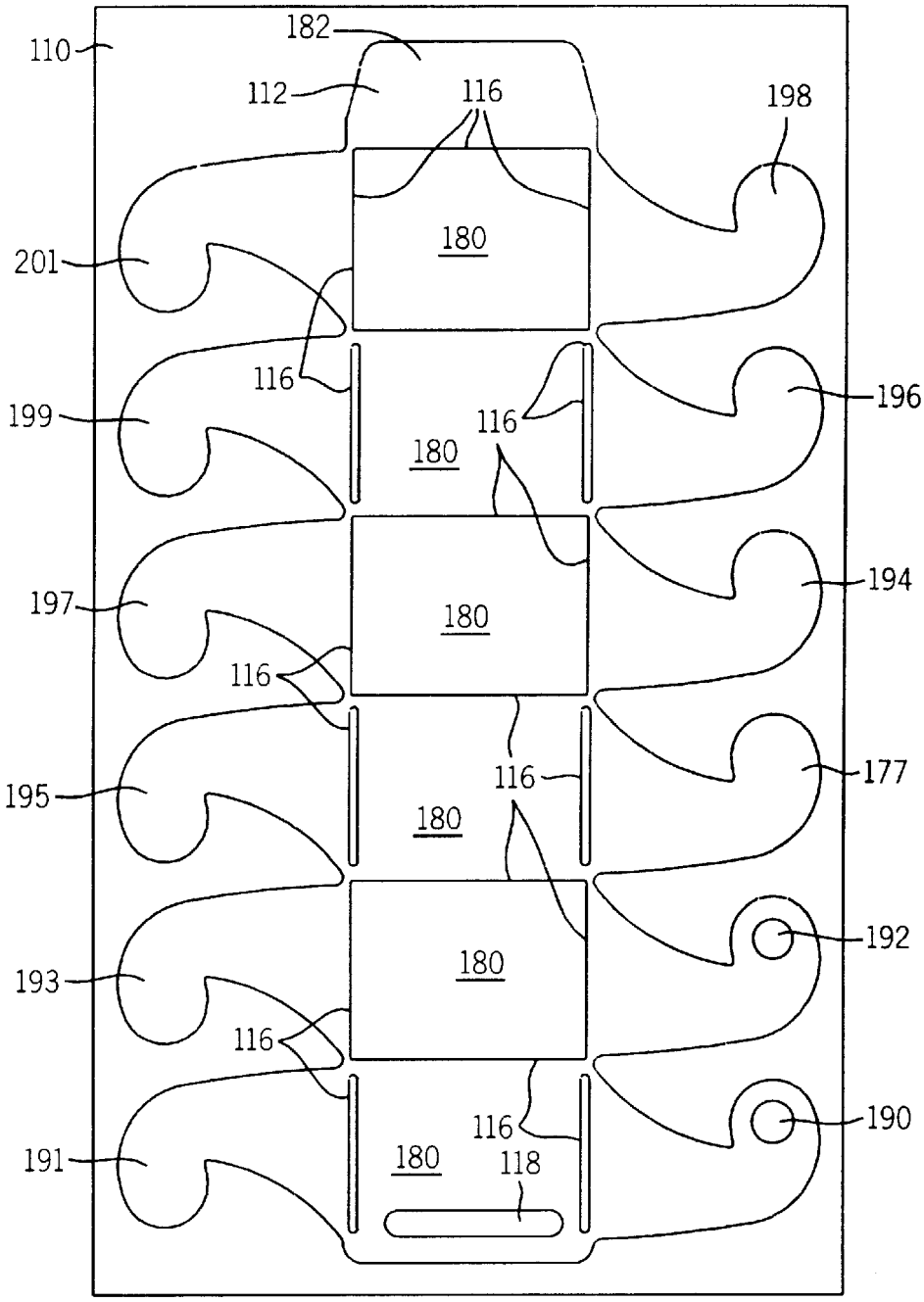
FIG. 18A is a top view of scoring plate for scoring the fold lines of the box defined by the template of FIG. 17.
Figure 18B:
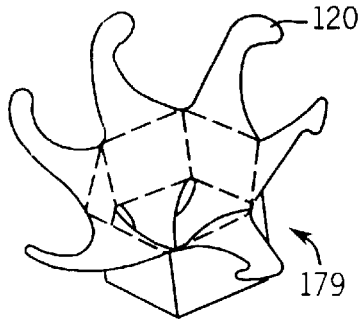
FIG. 18B is a perspective of a partially assembled box according to the embodiment shown in FIG. 17.

FIGS. 17, 18A and 18B show still another embodiment of the invention in which a multi-sided box 179 is formed. After the individual fold lines 116 are embossed using the scoring plate 110, a plurality of center portions 180 are formed and is surrounded by first through sixth tabs 190, 192, 177, 194, 196 and 198 on one side and seventh through twelfth tabs 191, 193, 195, 197, 199 and 201 on the other side. After glue or another adhesive is placed within the bonding slot 118, the unfolded box is folded such that an end tab 182 is folded onto the adhesive that was placed through the bonding slot 118, forming a tube. On one side of the center panels 180, the first tab 190 is folded over the tube, and the second and third tabs 192 and 177 are folded on top of the first tab 190. The fourth tab 194 is folded over the third tab 177 and hooked under the tip of the first tab 190. The fifth and sixth tabs 196 and 198 are also consecutively folded and hooked under the tip of the first tab 190. This procedure is repeated for the seventh through twelfth tabs 191, 193, 195, 197, 199 and 201 on the opposite side of the center panels 182. A perspective view of the box 179 in the partially assembled position is shown in FIG. 18*b*.

As shown in FIG. 17, it is also possible to include a variety of other shapes, such as hexagons 101, diamonds 103, hearts 105, ovals 107 and circles 109, into the individual template 100. These additional shapes can be used for a variety of purposes. For example, the hexagon 106 serves as a box inset which can be cut out and used to reinforce the bottom of the box 179 being created. The hexagon 106 is sized to fit snugly with the walls of the box when assembled and can be placed inside the assembled box 179 with or without adhesive.

Figure 19:
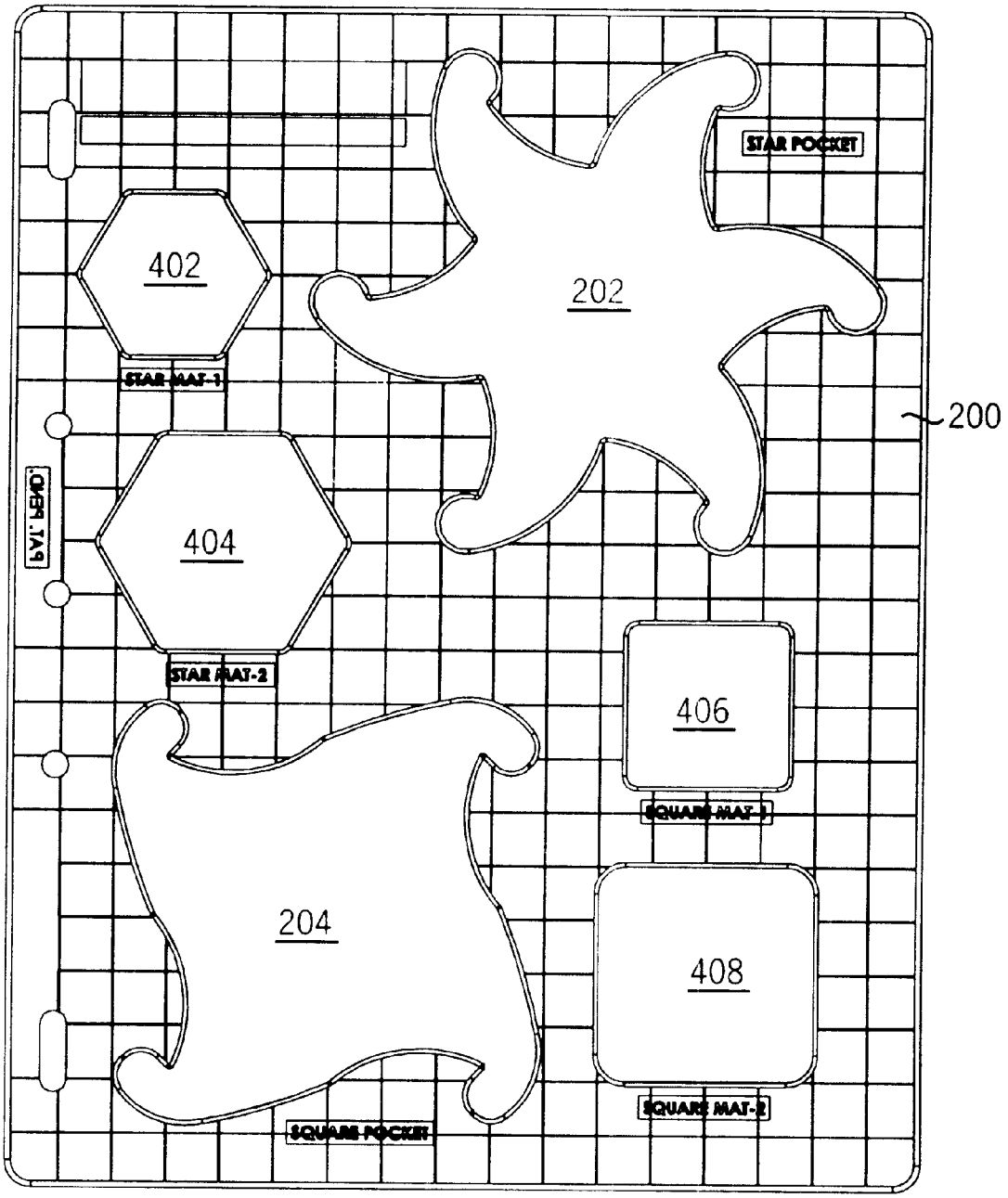
FIG. 19 is a top view of a template for cutting the shape of a plurality of memory pockets according to another embodiment of the present invention.
Figure 20:
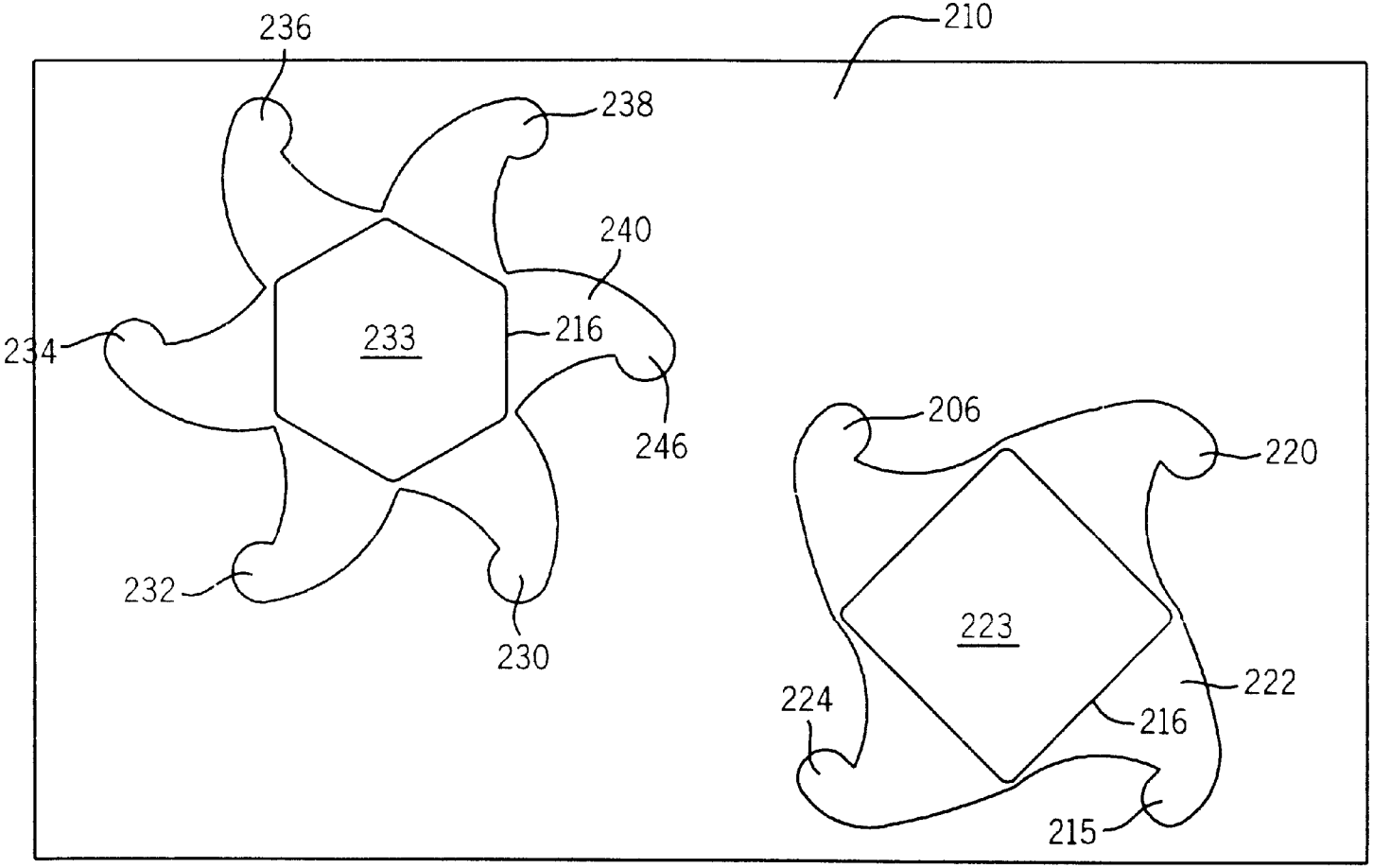
FIG. 20 is a top view of scoring plate for scoring the fold lines of the memory pockets defined by the template of FIG. 19.

As shown in FIGS. 19 and 20, it is also possible to have a single template 200 include multiple openings that are used for a variety of purposes. For example, a first opening 202 in the template 200 corresponds to a first memory pocket 246. The first memory pocket is capable of containing a small photograph therein. The unassembled first memory pocket 246 comprises a center portion 233 surrounded by a first tab 230, a second tab 232, a third tab 234, a fourth tab 236, a fifth tab 238 and a sixth tab 240. To assemble the first memory pocket 246, the first tab 230 is folded atop the center portion 233. The second and third tabs 232 and 234 are then consecutively folded on top of the first tab 230. The fourth tab 236 is folded over the third tab 234 and hooked under the tip of the first tab 230. The fifth and sixth tabs are sequentially folded down and also hooked under the first tab 230. All of these folds occur along the fold lines 216 that are embossed onto the unfolded first memory pocket 246. First and second star mats 402 and 404 are used to define and set the photograph to be displayed. In particular, the first star mat 402 is used to crop the photograph (not shown), while the second star mat 404 is used to create a backing for the cropped photograph. The cropped photograph is joined to the backing with adhesive or similar joining mechanisms before being placed inside the first in the first memory pocket 246. These components may be bonded to the inside of the first memory pocket 246 or simply placed inside the first memory pocket without any bonding materials.

The second opening 204 in the template 200 allows the user to form a second memory pocket 215. The unassembled second memory pocket 215 comprises a center portion 223 surrounded by a first tab 220, a second tab 222, a third tab 224 and a fourth tab 226. The second memory pocket 215 is assembled as follows. The first tab 220 is folded on top of the center portion 223. The second tab 222 is then folded on top of the first tab 220. The third tab 224 is folded on top of the second tab 222 and hooked under the tip of the first tab 220. The fourth tab 226 is then folded atop the third tab 224 and hooked under the tip of the first tab 220. All of these folds occur along the fold lines 216 that are embossed onto the unfolded second memory pocket 215. First and second square mats 406 and 408 are used to define and set the photograph to be displayed. In particular, the first square mat 406 is used to crop the photograph (not shown), while the second square mat 408 is used to create a backing for the cropped photograph. The cropped photograph is joined to the backing with adhesive or similar joining mechanisms before being placed inside the first in the first memory pocket 246. These components may be bonded to the inside of the first memory pocket 246 or simply placed inside the first memory pocket without any bonding materials.

Figure 21A:
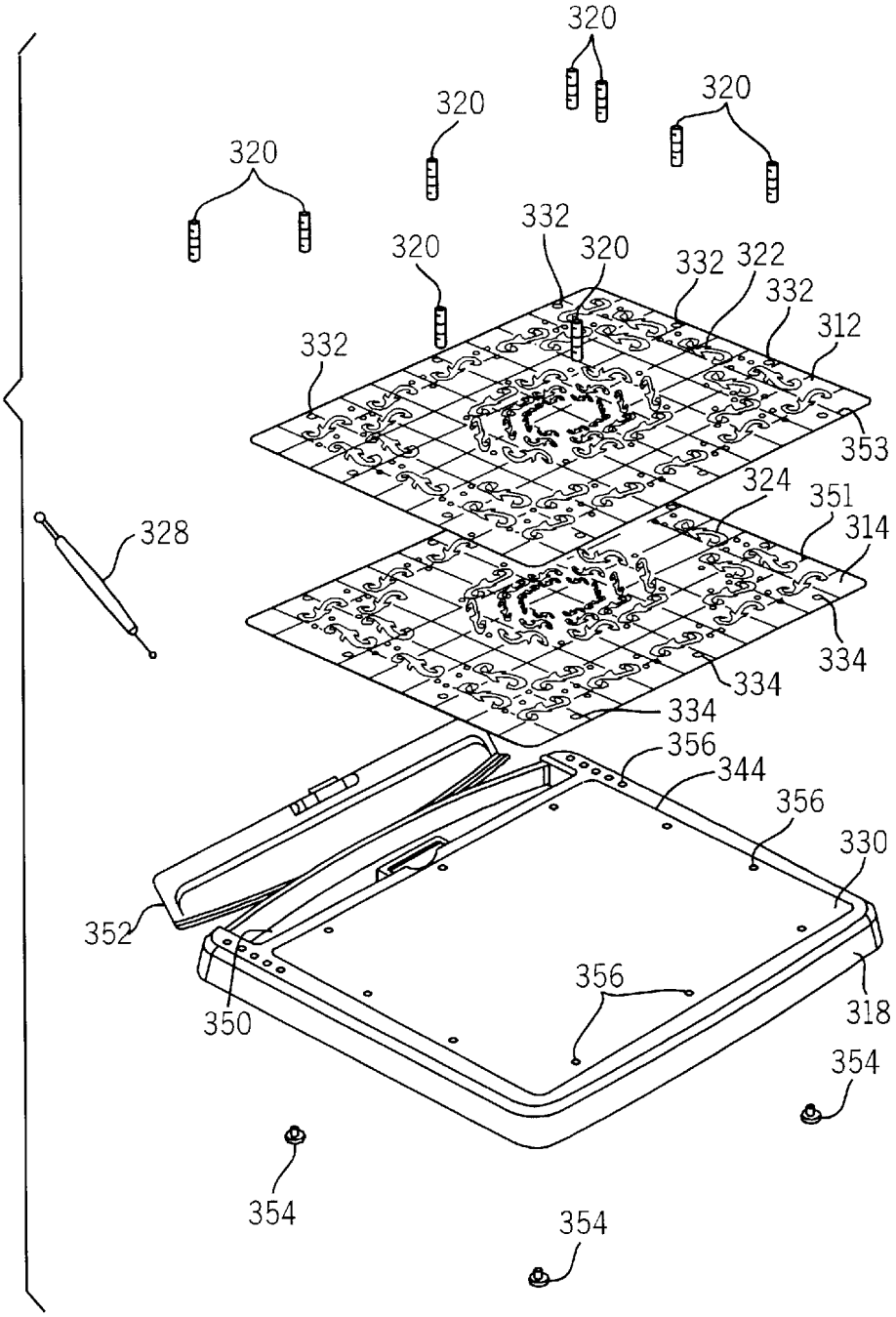
FIG. 21A is an exploded view of an embossing system according to one embodiment of the present invention.
Figure 21B:
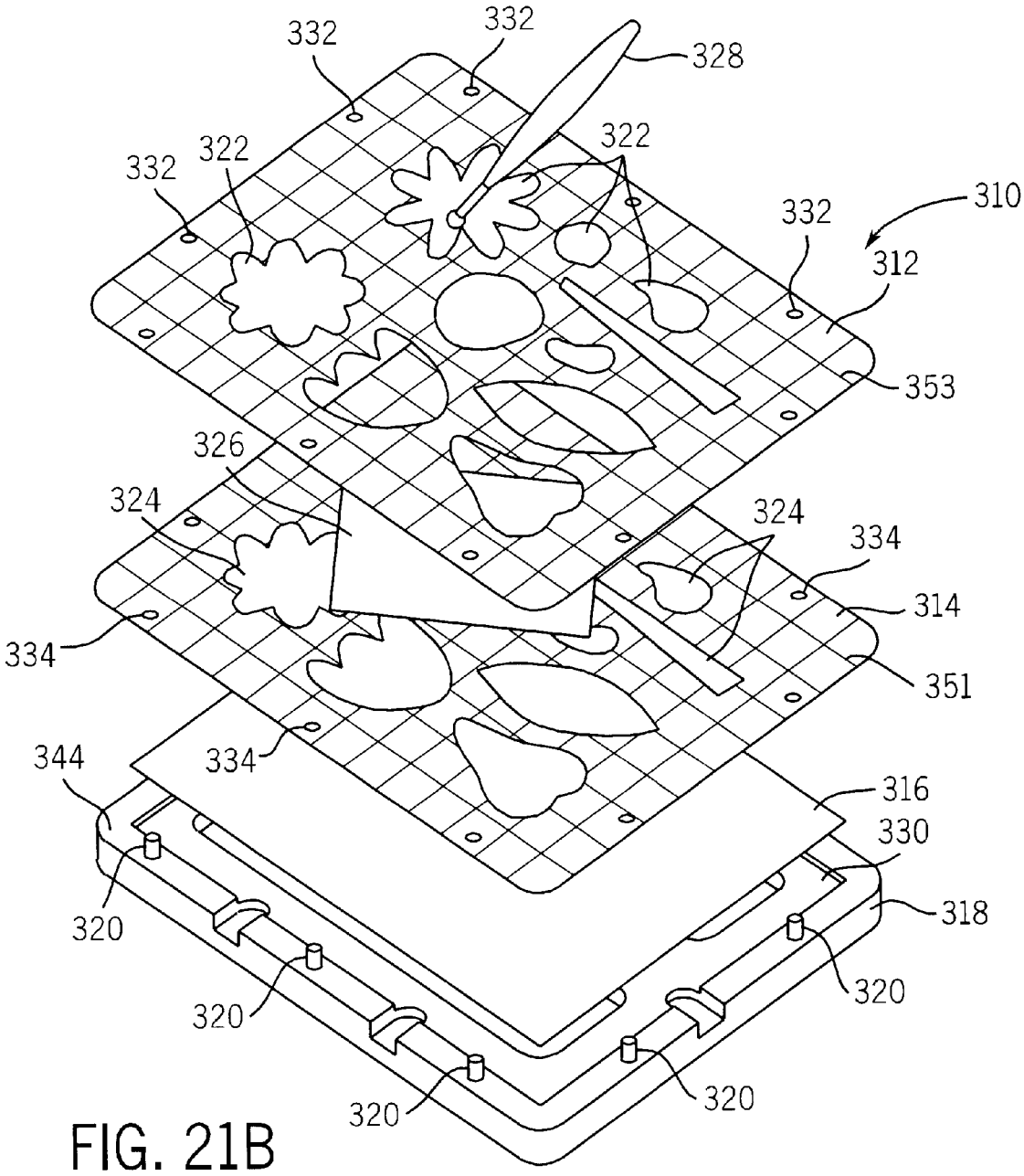
FIG. 21B is an exploded view of an embossing system according to another embodiment of the present invention.

The envelope cutting system of the present invention may also be used in conjunction with an embossing system as described in U.S. patent application Ser. No. 10/036,843, filed on Dec. 21, 2001 and entitled "Embossing System" and incorporated herein by reference. One such embossing system 310 is generally shown in FIGS. 21A–23. The embossing system 310 includes an upper template 312 and a lower template 314. As shown in FIG. 21B, a textured plate 316 may be positioned generally below the lower template 314. The textured plate 316 may include a variety of textured surfaces that may include grooves, ridges, undulations, or other textures. Alternatively, the textured plate 316 may include no texture at all depending upon the user's specific needs. The upper template 312, the lower template 314 and the textured plate 316 are al' removably positioned on top of a base plate 318.

The upper template 312 includes a plurality of upper template shapes 322. The upper template shapes 322 may vary greatly and could also include, for example, lettering, numbering or other designs. The lower template 314 includes a plurality of lower template shapes 324. The lower template shapes 324 may also vary but are substantially identical in both shape, size and position to the upper template shapes 322 on the upper template 312. In other words, the lower template shape 324 at a particular position on the lower template 314 is substantially identical to the upper template shape 322 at the same position on the upper template 312.

In one particular embodiment, the upper template shapes 322, although identical to the corresponding lower template shapes 324, are slightly larger than the corresponding lower template shapes 324. The slight different in sizes between the upper template shapes 322 and the corresponding lower template shapes 324 permit a user to make an improved, more crisp embossment along the edge of the shape to be embossed. In one embodiment, each upper template shape is about 0.050 larger in cross-section than the corresponding lower template shape 324.

The upper template 312, the lower template 314 and the textured plate 316 are all sized to fit on top of the base plate 318 in a close fitting relationship. As shown in FIG. 21B, the base plate 318, according to one embodiment, includes a small depression 330 which is sized such that the textured plate 316 and/or the upper template 322 and the lower template 324 fit therein.

According to a preferred embodiment, the upper template 312 and the lower template 314 matingly engage the base plate 318. This engagement is accomplished through the use of removable alignment pegs 320 positioned on the base plate 318 and corresponding upper template holes 332 and lower template holes 334, along with a plurality of base plate holes 356 located along the base plate 318. The alignment pegs 320 and the base plate holes 356 are positioned along an outer edge 344 of the base plate 318. It is also possible to have additional ones of the base plate holes 356 on the sides of the base plate 318 for storage purposes, as shown in FIG. 21A.

For each one of the alignment pegs 320, there is an upper template hole 332 and a lower template hole 334 located in an identical position on the upper template 312 and the lower template 314, respectively. The upper template holes 332 and lower template holes 334 are sized to closely fit with the alignment pegs 320 on the base plate 318. When the upper template holes 332, the lower template holes 334 and the alignment pegs 20 are in a mating engagement, the upper template 312 and the lower template 314 are impeded from moving relative to the base plate 318. This feature greatly aids the user in operating the embossing system 310 without the risk of inadvertent movement of the upper template 312 or the lower template 314. Additionally, this arrangement permits the upper template 312 and the lower template 314 from being completely removed from the base plate 318. This permits the user to use different types of templates on the same base plate 318, while also allowing the user to change the textured plate 316 depending upon the particular user needs.

According to one embodiment, the individual alignment pegs 320 are removable such that the user is able to use larger pieces of paper or other oversized mediums without bending the medium when a medium 326 is disposed inside the embossing system 310. This arrangement also permits the user of other templates of varying sizes which may or may not be provided with the embossing system 310.

In one embodiment, the embossing system 310 includes a storage compartment 350 with a lid 352. The storage compartment 350 and the lid 352 may be used to store a stylus 328, other marking instruments and/or the alignment pegs 320. A variety of types of locking mechanisms may be used to secure the lid 352, enclosing the storage compartment 350.

The overall size of the embossing system 310 may vary depending upon the particular user requirements. In one embodiment, the embossing system 310 will be of a size to correspond to standard 8 ½" by 11" paper. Alternatively, the embossing system 310 could be sized to better fit standard greeting cards or other paper items. The embossing system may include a plurality of feet 354 coupled to the underside of the base plate 318. The feet 354, which may be formed from rubber or other materials, prevent or impede the base plate 318 from sliding along the surface upon which the embossing system 310 is placed.

The upper template 312 and the lower template 314 may be formed from PET or biaxially oriented film or mylar and can be transparent and/or tinted. The upper template 312 may include a preprinted upper template grid 352, and the lower template 314 may include a preprinted lower template grid 350. The upper template grid 352 and the lower template grid 350 may be used for properly aligning the medium 326. The embossing system 310 may also include a self-healing cutting mat (not shown). The thickness of the upper template 312 and the lower template 314 may vary depending upon the particular use.

In a preferred embodiment, the lower template 314 has a thickness of about 0.010–0.020 inches and is formed from an opaque, colored plastic material. In a most preferred embodiment, the lower template 314 has a thickness of about 0.010 inches. It has been observed that when the lower template 314 has a thickness of about 0.010 inches, the medium is less likely to be torn during the embossing process than when the lower template 314 has a greater thickness. In a most preferred embodiment, the upper template 312 has a greater thickness than the lower template, and it has been found that there is improved quality in the embossment when the upper template 312 and the lower template 314 have different thicknesses. In a preferred embodiment, the upper template has a thickness of about 0.015–0.020 inches, with a most preferred thickness of about 0.015 inches. Other thicknesses for the upper template 312 and the lower template 314 may be used, and it is also possible for the upper template 312 and the lower template 314 to be of substantially identical thicknesses.

The upper template 312 and the lower template 314 may be laser cut, water jet cut, die cut, or punched out of sheet material. In one particular embodiment, the base plate 318 is injection molded.

The embossing system 310 includes the stylus 328 or similar marking mechanism for embossing or scoring the medium 326. A variety of types of marking mechanisms may be used. One exemplary form of marking device includes a ball bearing at one end thereof. One such device is currently marketed under the name EMPRESSOR™ Alternatively, a pencil or other drawing instrument could be used in place of the stylus 328. The embossing system 310 can be used on a variety of the medium including without limitation paper, card stock, bond paper, thirty pound vellum, metal foil, and other such materials.

The operation of the embossing system 310 is generally as follows. When a user desires to emboss a particular material, the user first selects the proper textured plate 316 and locates the selected textured plate 316 within the depression 330 of the base plate 318. The user selects the particular shape to be embossed on the material, and places the lower template 314 containing that shape atop the base plate 318, aligning the lower template holes 334 with the alignment pegs 320. The user then positions the medium 326 on top of the lower template 314 in such a position as to cover the particular shape to be scored. Once the medium 326 is in a proper position, the user locates the upper template 312 on top of the medium 326 and the lower template 314, aligning the upper template holes 332 with the alignment pegs 320. The user maneuvers the stylus 328 within the particular upper template shape 322 which is to be embossed on the material 326. During this process, the user may maneuver the stylus 328 along only the outer edge of the upper template shape 322, or may maneuver it throughout the region. When the user is done maneuvering or scoring the upper template shapes 322, the user removes the upper template 312. The material 326 then includes an embossment corresponding to the upper template shape 322 and the lower template shape 324.

Figure 22:
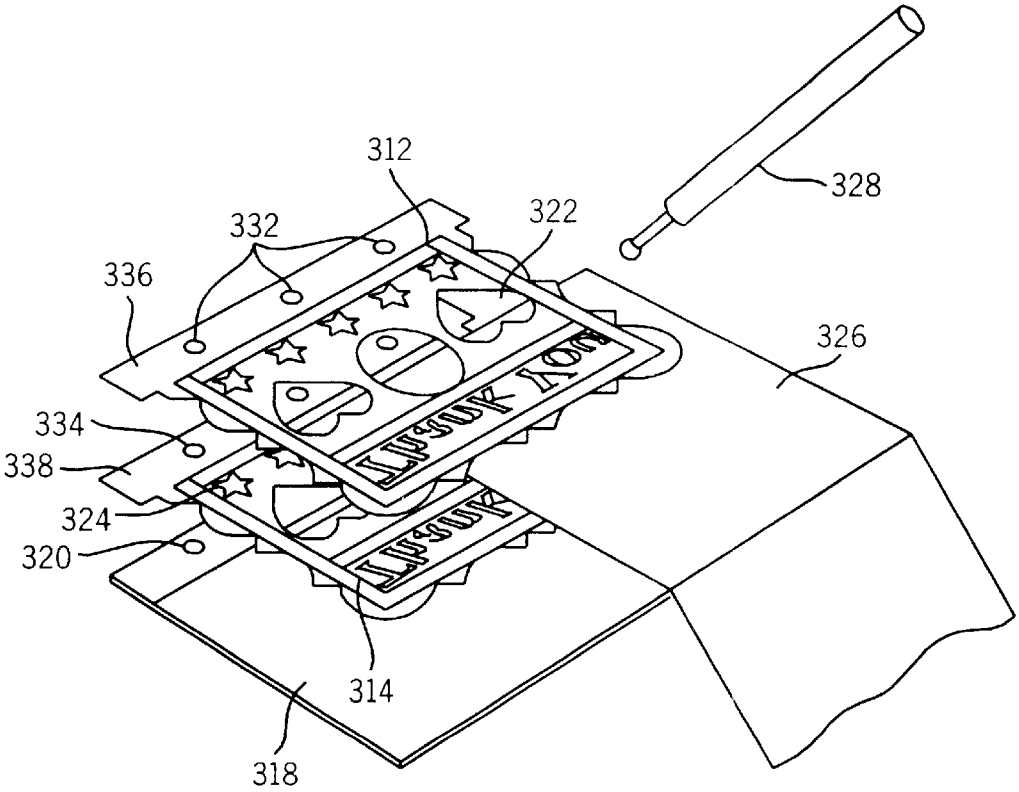
FIG. 22 is a perspective view of an embossing system according to an alternate embodiment of the invention.

According to an alternate embodiment and as shown in FIG. 22, the upper template 312 and the lower template 314 can be a variety of shapes and may also only include the upper template holes 332 and the lower template holes 334 on an upper template margin 336 and a lower template margin 338, respectively. Although the positioning of the individual upper template holes 332 and the lower template holes 334 can vary, the upper template holes 332 and the lower template holes 334 still operate to fix the position of the upper template 312 and lower template 314 so long as they mate with the alignment pegs 320 on the base plate 318. In one embodiment, the upper template holes 332 and the lower template holes 34 are positioned to align with the standard European and/or American binder hole arrangements.

Figure 23:
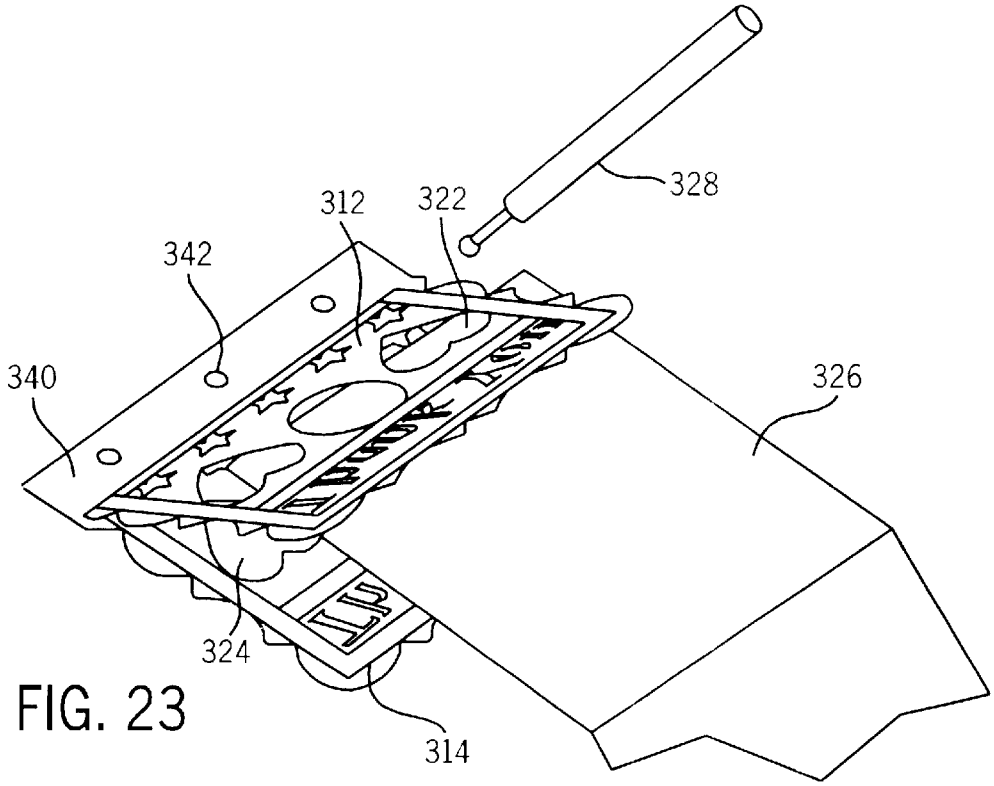
FIG. 23 is a perspective view of an embossing system according to yet another embodiment of the invention.

In still another embodiment and as shown in FIG. 23, the upper template 312 and the lower template 314 are joined together at a single margin 340 that includes margin alignment holes 342. The single margin 340 provides the user the added benefit of keeping the upper template 312 and the lower template 314 together at all times, minimizing the risk of at least one of the upper template 312 or the lower template 314 being lost. In this particular, the upper template 312 and the lower template 314 are hingedly or flexedly connected to each other such that the medium 326 can be easily positioned and removed from the embossing system 310.

In yet another embodiment, an integrated clamp (not shown) may be used to further clamp the individual components of the embossing system 310 in place. For example, the integrated clamp can be used as a ruler for measuring and alignment of the medium 326 or other items in the embossing system 310. The clamp can be spring tensioned to hold the individual components securely in place.

The embossing system 310 may also include a storage lid (not shown) sized to fit on top of the upper and the lower templates 312 and 314, the textured plate 316 and the base plate 318, mating with the alignment pegs 320 to safely secure all of the components. Additionally, a small light (not shown) may be positioned inside the depression 330. The light may be used to illuminate the material 326 being embossed, making it easier for the user to identify whether the material 326 has been embossed and, if so, the degree of embossment.

While the preferred embodiments of the present invention have been described and illustrated, numerous departures therefrom can be contemplated by persons skilled in the art, for example, the cutting unit 12 can include alternative blade adjustment assembly designs comprising a gear assembly or a remotely operated assembly. Additionally, the cutting unit can be configured to reciprocate or continuously rotate about the axis. A variety of envelopes and packages of different shapes could formed, and the types of structures used for joining portions of the envelopes and packages to each other could comprise a variety of types of adhesives, slots, hooks, and other mechanisms known to those in the art. Therefore, the present invention is not limited to the foregoing description but only by the scope and spirit of the appended claims.

What is claimed is:

1. An envelope cutting system for cutting a material having a surface, the system comprising:

a cutting unit including a frame having a lower support surface, a blade adjustment assembly coupled to the frame, and a blade assembly operatively connected to the frame, the blade assembly positioned at least partially within the frame such that a longitudinal axis of the blade assembly is substantially perpendicular to the lower support surface of the frame, the blade assembly including a blade retainer and a blade connected to the retainer, the retainer having a rigid collar, and the blade assembly and blade tip rotatable about the longitudinal axis, and a template having first and second substantially flat surfaces, a periphery and at least one edge defining at least one opening forming the shape of an unfolded envelope, the at least one edge including a chamfered surface running substantially between the first and second substantially flat surfaces, the lower support surface of the frame configured for contacting the first surface of the template and, the second surface of the template configured for placement upon the material to be cut, the rigid collar of the retainer configured to operatively engage at least one of the periphery and the edge of the opening of the template, thereby enabling the blade to cut a shape in the material which assimilates the shape of at least a portion of the at least one of the periphery and the edge.

2. The envelope cutting system of claim 1, further comprising at least one scoring plate having at least one scoring region corresponding to the fold lines on the envelope defined by the at least one opening.

3. The envelope cutting system of claim 2, wherein the at least one scoring plate includes at least one secondary region corresponding to where a bonding material is placed on the envelope defined by the at least one opening.

4. The envelope cutting system of claim 2 wherein the scoring plate comprises a generally transparent material.

5. The envelope cutting system of claim 1 further comprising a cutting mat, the cutting mat configured for placement under the material to be cut, the template and the cutting unit.

6. The envelope cutting system of claim 5 wherein the cutting unit includes a cap covering the lower surface of the frame and the lower portion of the blade assembly.

7. The envelope cutting system of claim 1 wherein the frame includes a base and a housing coupled to the base, wherein the housing is configured to enclose at least a portion of the blade adjustment assembly and the blade assembly, wherein the blade assembly extends along a first axis, and wherein the lower surface of the base defines a plane which is substantially perpendicular to the first axis.

8. The envelope cutting system of claim 1 wherein the frame includes a compartment for storing at least one spare blade assembly.

9. The envelope cutting system of claim 1, wherein the blade assembly is rotatable about the first axis in at least one of a clockwise and a counterclockwise direction.

10. The envelope cutting system of claim 1 wherein the blade adjustment assembly includes an operating mode indicator, wherein when the operating mode indicator is in a first operating position, a low amount of pressure is exerted on the blade, permitting the blade to axially deflect during cutting, and wherein when the operating mode indicator is in a second operating position, an increased amount of pressure is exerted against the blade, preventing the blade from axially deflecting during cutting.

11. The envelope cutting system of claim 10 wherein the first operating position is a free-form cutting position and wherein the second operating position is a template cutting position.

12. The envelope cutting system of claim 1 wherein the template comprises a generally transparent tinted material, and wherein the material of the template includes an edge glow substance operably disposed with structure of template surfaces to redirect light toward the periphery and the edge of the at least one opening of the semi-transparent material.

13. The envelope cutting system of claim 1, wherein the blade adjustment assembly comprises an adjusting knob, a plunger, and a biasing member in contact with both the adjusting knob and the plunger, the adjusting knob applying pressure directly against the biasing member.

14. A package cutting system comprising:

a cutting unit including a frame having a lower support surface, a blade adjustment assembly coupled to the frame, and a blade assembly operatively connected to the frame, the blade assembly positioned at least partially within the frame such that a longitudinal axis of the blade assembly is substantially perpendicular to the lower support surface of the frame, the blade assembly including a blade retainer and a blade connected to the retainer, the retainer having a rigid collar, and the blade assembly and blade tip rotatable about the longitudinal axis;

a template having first and second substantially flat surfaces, a periphery and at least one edge defining at least one opening forming the shape of an unfolded package, the at least one edge including a chamfered surface running substantially between the first and second substantially flat surfaces, the lower support surface of the frame configured for contacting at least one of the first surface of the template and the material to be cut, the second surface of the template configured for placement upon the material to be cut, the rigid collar of the retainer configured to operatively engage at least one of the periphery and the edge of the opening of the template, thereby enabling the blade to cut a shape in the cutting material which assimilates the shape of at least a portion of the at least one of the periphery and the edge;

a scoring plate including at least one scoring region corresponding to the fold lines on the package defined by the at least one opening and at least one secondary region corresponding to where a joining material is placed on the package defined by the at least one opening; and a cutting mat configured for placement under the material to be cut, the template and the cutting unit.

15. The package cutting system of claim 14 wherein the cutting unit includes a cap covering the lower surface of the frame and the lower portion of the blade assembly.

16. The package cutting system, of claim 15 wherein the template is made of a generally transparent tinted material, and wherein the material of the template includes an edge glow substance operably disposed with structure of template surfaces to redirect light toward the periphery and the edge of the at least one opening of the semi-transparent material.

17. The package cutting system of claim 15 wherein the scoring plate is made of a generally transparent material.

18. The package cutting system of claim 14, wherein the blade assembly is rotatable about the first axis in at least one of a clockwise and a counterclockwise direction.

19. The package cutting system of claim 14 wherein the frame includes a base and a housing coupled to the base, wherein the housing is configured to enclose at least a portion of the blade adjustment assembly and the blade assembly, wherein the blade assembly extends along a first axis, and wherein the lower surface of the base defines a plane which is substantially perpendicular to the first axis.

20. The package cutting system of claim 14 wherein the frame includes a compartment for storing at least one spare blade assembly.

* * * * *